US010547934B2

(12) United States Patent
Baggs et al.

(10) Patent No.: US 10,547,934 B2
(45) Date of Patent: Jan. 28, 2020

(54) SPEAKER ASSEMBLIES WITH WIDE DISPERSION PATTERNS

(71) Applicant: Lloyd Baggs Innovations, LLC, Nipomo, CA (US)

(72) Inventors: Lloyd Baggs, Nipomo, CA (US); Clifford A. Henricksen, Framingham, MA (US); Thomas Linn, San Luis Obispo, CA (US)

(73) Assignee: Lloyd Baggs Innovations, LLC, Nipomo, CA (US)

( * ) Notice: Subject to any disclaimer, the term of this patent is extended or adjusted under 35 U.S.C. 154(b) by 0 days.

(21) Appl. No.: 15/361,342

(22) Filed: Nov. 25, 2016

(65) Prior Publication Data

US 2017/0150251 A1 May 25, 2017

Related U.S. Application Data

(60) Provisional application No. 62/259,597, filed on Nov. 24, 2015.

(51) Int. Cl.
*H04R 1/30* (2006.01)
*H04R 1/26* (2006.01)
(Continued)

(52) U.S. Cl.
CPC ..... *H04R 1/30* (2013.01); *H04R 1/26* (2013.01); *H04R 1/323* (2013.01); *H04R 1/403* (2013.01)

(58) Field of Classification Search
CPC ..... H04R 1/30; H04R 1/345; H04R 1/403; H04R 1/24; H04R 1/323; H04R 1/32; H04R 1/025; H04R 1/26
(Continued)

(56) References Cited

U.S. PATENT DOCUMENTS 3,483,945 A * 12/1969 Stanley ..... H04R 1/323 181/143
4,310,065 A * 1/1982 Kayman ..... G10K 11/025 181/159
(Continued)

OTHER PUBLICATIONS

"Wave Diffraction", University of Salford Manchester, http://www.acoustics.salford.ac.uk/feschools/waves/diffract3.php, dated Nov. 22, 2016, 5 pages.
(Continued)

*Primary Examiner* — Oyesola C Ojo
(74) *Attorney, Agent, or Firm* — KPPB LLP

(57) ABSTRACT

Systems and methods for speaker assemblies with wide dispersion patterns are disclosed. In one embodiment, a speaker assembly includes at least two speaker drivers and a diffraction baffle affixed to each speaker driver, where each diffraction baffle includes a baffle face having a diffraction slot positioned over the driver and each diffraction baffle is affixed to and sealed to the driver, the area across each diffraction slot is less than the surface area of the driver, each diffraction slot provides a path for substantially all of the acoustic pressure waves produced by the speaker driver to propagate away from the driver and the acoustic pressure waves are within a frequency range determined by the characteristics of the driver, and the width of each diffraction slot in the horizontal direction is equal to the wavelength of a predetermined target frequency.

36 Claims, 39 Drawing Sheets

(51) Int. Cl.
*H04R 1/32* (2006.01)
*H04R 1/40* (2006.01)

(58) Field of Classification Search
USPC ..... 381/342
See application file for complete search history.

(56) References Cited

U.S. PATENT DOCUMENTS

| | | | | |
|---|---|---|---|---|
| 4,923,031 | A * | 5/1990 | Carlson | H04R 1/2819 181/144 |
| D328,462 | S | 8/1992 | Christie | |
| D355,914 | S | 2/1995 | Jewitt et al. | |
| 5,402,502 | A | 3/1995 | Boothroyd et al. | |
| D376,364 | S | 12/1996 | Boothroyd et al. | |
| 5,715,322 | A * | 2/1998 | Yoshioka | H04R 1/08 181/144 |
| D397,117 | S | 8/1998 | Jones | |
| D429,235 | S | 8/2000 | Genatossio et al. | |
| 6,112,847 | A | 9/2000 | Lehman | |
| D450,778 | S | 11/2001 | Engebretson | |
| D470,474 | S | 2/2003 | Kobayashi | |
| 6,658,128 | B1 * | 12/2003 | Yoshioka | H04R 1/30 181/177 |
| D519,105 | S | 4/2006 | Masui | |
| D567,214 | S | 4/2008 | Fynboe et al. | |
| D573,585 | S | 7/2008 | Belanger et al. | |
| D592,645 | S | 5/2009 | Motoishi | |
| D609,217 | S | 2/2010 | Manini | |
| 7,802,650 | B2 * | 9/2010 | Bartlett | H04R 1/30 181/179 |
| 8,181,736 | B2 | 5/2012 | Sterling et al. | |
| D671,525 | S | 11/2012 | Chung | |
| D671,526 | S | 11/2012 | Lee et al. | |
| D682,250 | S | 5/2013 | Mattioli | |
| D691,591 | S | 10/2013 | Lum et al. | |
| D698,335 | S | 1/2014 | Plattard | |
| 9,111,521 | B2 * | 8/2015 | Blore | G10K 11/025 |
| D741,795 | S | 10/2015 | Conrad et al. | |
| D769,214 | S | 10/2016 | Warden | |
| 2003/0209384 | A1 * | 11/2003 | Dalbec | G10K 11/025 181/182 |
| 2003/0228021 | A1 * | 12/2003 | Letinturier | B60R 25/104 381/86 |
| 2009/0046875 | A1 * | 2/2009 | Masuda | H04R 1/30 381/152 |
| 2012/0279797 | A1 | 11/2012 | Sterling et al. | |
| 2014/0112513 | A1 * | 4/2014 | Hsu Huang | H04R 1/30 381/340 |
| 2014/0119588 | A1 * | 5/2014 | LaCarrubba | G10K 11/28 381/340 |
| 2014/0270309 | A1 * | 9/2014 | McKinnon | H04R 1/323 381/342 |

OTHER PUBLICATIONS

Heutschi, Kurt, "Acoustics II: electrical-mechanical-acoustical analogies", Swiss Federal Institute of Technology Zurich, Jan. 18, 2013, 91 pages.
Heutschi, Kurt, "Acoustics II: loudspeakers", Swiss Federal Institute of Technology Zurich, Jan. 18, 2013, 120 pages.
Heutschi, Kurt, "Practical course: Loudspeakers", Acoustics II, Feb. 22, 2012, pp. 1-7.
"Avantgarde Acoustic Horn Technology Video", YouTube, May 31, 2011, retrieved on https://www.youtube.com/watch?v=kPywOtjXJ10 on May 13, 2019, 3 pages.
"Horn-Loaded Standard Dome Tweeters, p. 1", diyAudio, Dec. 17, 2006, retrieved from https://www.diyaudio.com/forums/multi-way/92375-horn-loading-standard-dome-tweeters.html on May 13, 2019, 5 pages.
"Horn-Loaded Standard Dome Tweeters, p. 2", diyAudio, Dec. 17, 2006, retrieved from https://www.diyaudio.com/forums/multi-way/92375-horn-loading-standard-dome-tweeters-2.html?s=35002968a505625252fa77e55194ce9f on May 13, 2019, 3 pages.
"HR4 Studio Monitors", OceanWay Audio, Oct. 27, 2015, retrieved from https://oceanwayaudio.com/hr4/ on May 13, 2019, 7 pages.
"Triangle Signature Delta Tower Speaker Overview", Mar. 10, 2015, retrieved on http://forums.audioholics.com/forums/threads/triangle-signature-delta-tower-speakeroverview.93945/ on May 13, 2019, 7 pages.
Burnett, John, "Compression drivers", Dec. 9, 2008, retrieved from http://education.lenardaudio.com/en/07_horns_2.html on May 13, 2019, 6 pages.
Day, Jeff, "The Tao of Tannoy: The Westminster Royal Special Edition Loudspeakers", Positive Feedback, Issue 49, May 2010, retrieved on http://www.positive-feedback.com/Issue49/tannoy.htm on May 13, 2019, 24 pages.
Gravesen, Troels, "Vifa C17-11, Monacor DT300+waveguide", 2010, retrieved from http://www.troelsgravesen.dk/C17_II.htm on May 13, 2019, 11 pages.
Kolbrek, Bjorn, "Horn Theory: An Introduction, Part 1", audioXpress, 2008, https://www.grc.com/acoustics/an-introduction-to-horn-theory.pdf, pp. 1-17.
Krutke, John, "What happens when you horn load a dome tweeter?", Zaph Audio, May 31, 2005, retrieved from http://www.zaphaudio.com/hornconversion.html on May 13, 2019, 8 pages
Micallef, Ken, "Orangutan O/93 Loudspeakers", Positive Feedback, Sep. 2014, Issue 75, retrieved from http://www.positive- feedback.com/Issue75/devore_orangutan.htm on May 13, 2019, 15 pages.
White, Robert C., "Practical DIY Waveguides—Part 3", Nov. 3, 2006, retrieved from http://sound.whsites.net/articles/waveguides3.htm on May 13, 2019, 9 pages.
"Caste Speakers", Worldwide Wholesales, Nov. 4, 2016, retrieved from http://web.archive.org/web/20161104091154/https://worldwidewholesales.com/technologies/casta-speakers! on Aug. 22, 2019, 4 pages.
http://redspade-audio.blogspot.com/2013/07/altec-a7-voice-of-theatre-hornsmeasured.html, Dec. 14, 2015, (web page no longer active, archive copy cannot be found).
http://speakeraddict.com/mid-high-frequency/horn-tweeters/vifa-horn-tweeter-1-domebc25sc06-04ohm-high-efficiency.html, Dec. 14, 2015, (web page no. longer active, archive copy cannot be found).
http://www.teufelaudio.com/blog/audio-knowledge/3-common-types-of-loudspeakerdriver-design/, Dec. 14, 2015, (web page no. longer active, archive copy cannot be found).
"Acasa Boxe de centru", Yamaha Shop, Dec. 14, 2015, retrieved from http://yamahashop.xhost.ro/Boxe_de_centru.htm on Aug. 23, 2019, 29 pages.
"Addition No. Fourteen Loudspeaker System Types", The PA Bible, Dec. 14, 2015, http://www.datalinkplus.com/procomm/BASICTR/PABBLWEB/14LoudspeakerSytemTypes.pdf, 4 pages.
"Avantgarde Acoustic Adric Technology", Purity Meets Performance, Avantgarde Acoustic, Dec. 14, 2015, 4 pages.
"Loudspeakers CBR Series", Yamaha, Nov. 21, 2015, retrieved from http://web.archive.org/web/20151121182448/http://www.yamahaproaudio.com/global/en/products/speakers/cbr/features.jsp on Aug. 23, 2019, 2 pages.
"Low Frequency Enclosures", JBL, Dec. 14, 2015, http://www.jblpro.com/pub/obsolete/Low_Frequency_Enclosures2.pdf, 6 pages.
"Altec Lansing Voice of the Theatre (VOTT)", Great Plains Audio, Jul. 1, 2017, retrieved from https://greatplainsaudio.com/altec-lansing-library/altec-lansing-voice-theatre-vott/ on Aug. 29, 2019, 2 pages.
"Vifa, BC25SC06", Meniscus Audio, Dec. 14, 2015, retrieved from https://meniscusaudio.com/product/vifa-bc25sc06/ on Aug. 29, 2019, 4 pages.
"Voice of the Theatre", Altec Lansing, Jan. 1, 1983, retrieved from https://greatplainsaudio.com/wp-content/uploads/2017/07/VOTT.1983.pdf on Aug. 29, 2019, 15 pages.

* cited by examiner

FIG. 9A
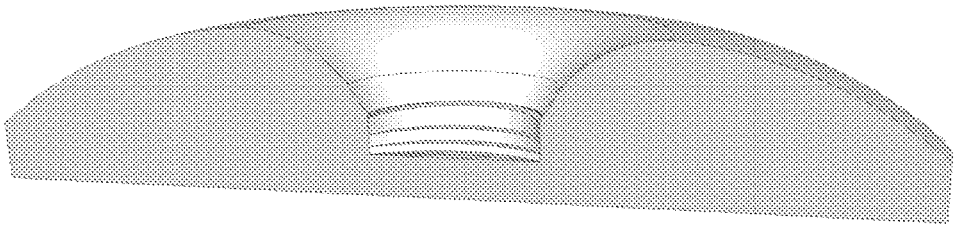
FIG. 9B
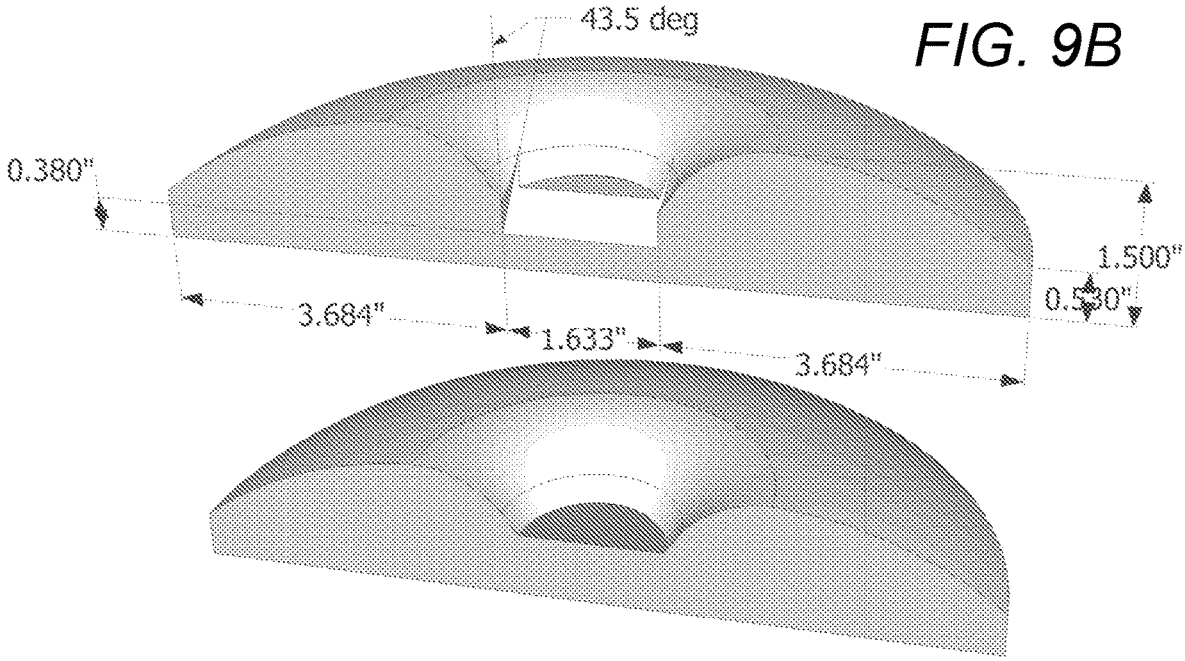
FIG. 9C

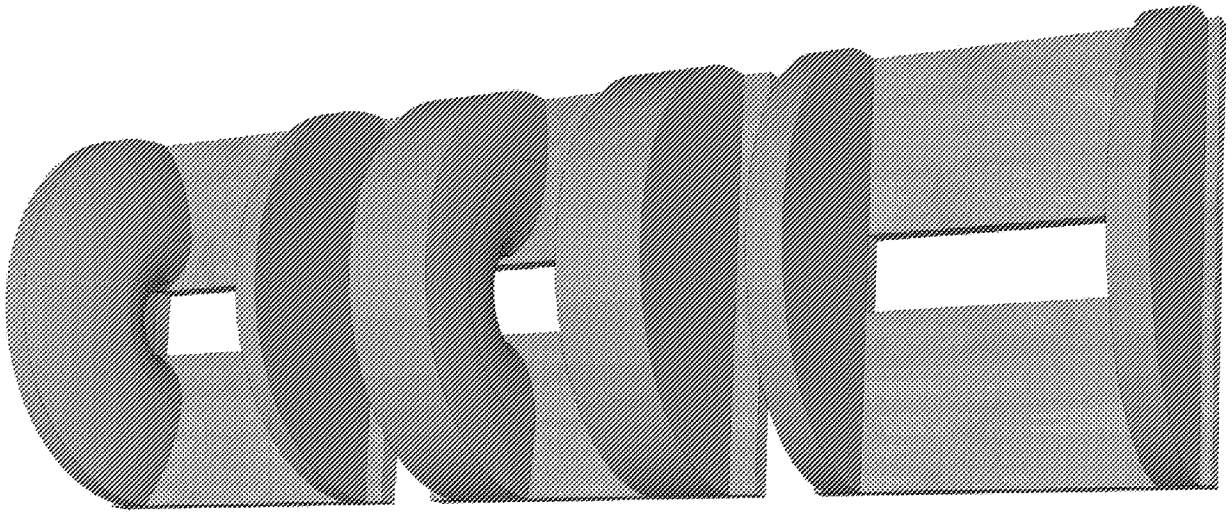
FIG. 11A
FIG. 11B
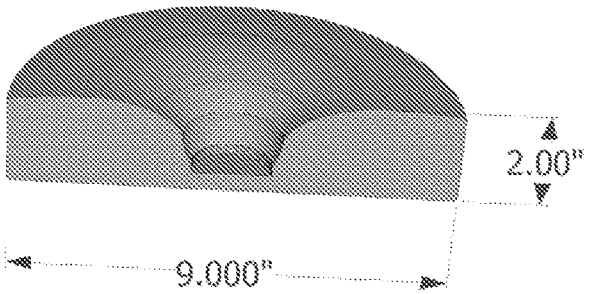
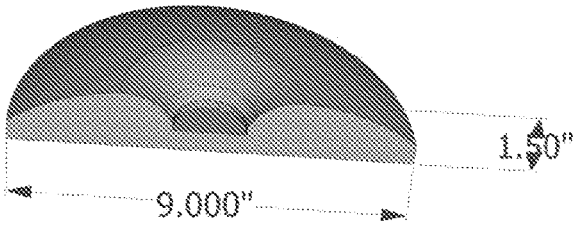
FIG. 11C

SPEAKER ASSEMBLIES WITH WIDE DISPERSION PATTERNS

CROSS-REFERENCE TO RELATED APPLICATIONS

The present application claims priority to U.S. Provisional Patent Application No. 62/259,597, entitled Multiple Horn Speaker Assemblies with Wide Dispersion Patterns, filed Nov. 24, 2015, the disclosure of which is hereby incorporated by reference in its entirety.

FIELD OF THE INVENTION

The present invention relates generally to loudspeakers and more specifically to loudspeakers utilizing diffraction baffles having wide dispersion patterns.

SUMMARY OF THE INVENTION

Systems and methods for speaker assemblies with wide dispersion patterns are disclosed. In one embodiment, a speaker assembly for sound dispersion includes at least two speaker drivers and a diffraction baffle affixed to each of the speaker drivers, where each diffraction baffle includes a baffle face having a diffraction slot positioned over the corresponding speaker driver and each diffraction baffle is affixed to and sealed to the corresponding speaker driver such that substantially all acoustic pressure produced from the front of the driver passes through the diffraction slot, where the area across each diffraction slot is less than the surface area of the corresponding speaker driver, where each diffraction slot provides a path for substantially all of the acoustic pressure waves produced by the corresponding speaker driver to propagate away from the speaker driver and the acoustic pressure waves are within a frequency range determined by the characteristics of the speaker driver, and where the width of each diffraction slot in the horizontal direction is equal to the wavelength of a predetermined target frequency.

In a further embodiment, the at least two speaker drivers are oriented in vertical alignment with each other.

In another embodiment, the at least two speaker drivers are oriented to face the same direction.

In a still further embodiment, the speaker assembly also includes an upper horn flare affixed to the upper throat surface of the throat region and oriented horizontally, and a lower horn flare affixed to the lower throat surface of the throat region and oriented horizontally.

In still another embodiment, the upper horn flare and the lower horn flare are curved with an exponential transition.

In a yet further embodiment, one of the speaker drivers is a tweeter and the width of the diffraction slot over the tweeter is 0.5 inch.

In yet another embodiment, one of the speaker drivers is a woofer and the width of the diffraction slot over the woofer is 1.625 inches.

In a further embodiment again, at least one diffraction baffle also includes a phase plug positioned over the corresponding speaker driver and forming an inner path toward the corresponding diffraction slot.

In another embodiment again, the edges of the exit of each diffraction slot all fall within one plane.

In a further additional embodiment, the edges of the exit of each diffraction slot fall within one plane in an orientation parallel to the orientation of the corresponding speaker driver.

In another additional embodiment, each diffraction baffle includes a throat region including an upper throat surface protruding from the top of the exit of the diffraction slot and a lower throat surface protruding from the bottom of the exit of the diffraction slot, shaped to match its interface to the diffraction slot, the slope of the upper throat surface and the slope of the lower throat surface are dimensioned to maintain the surface area of wavefronts of acoustic pressure waves at the predetermined target frequency to be constant at each distance the wavefronts progress through the throat region, and the throat region narrows in a vertical dimension towards its opposite end.

In a still yet further embodiment, the predetermined target frequency associated with each diffraction slot is at the upper bound of the frequency range produced by the corresponding speaker driver.

In still yet another embodiment, a diffraction baffle for a speaker assembly includes a baffle face configured to be attachable to, positioned over, and sealed together with a speaker driver, the baffle face having a diffraction slot dimensioned to disperse acoustic pressure waves within a range of frequencies produced by the speaker driver, the range of frequencies including a predetermined target frequency, and the diffraction slot having an entrance facing the speaker driver and an exit facing away from the speaker driver where the area across the diffraction slot is less than the surface area of the speaker driver, and the width dimension of the diffraction slot is equal to the wavelength of an audio wave having the frequency at the predetermined target frequency, and a throat region including an upper throat surface protruding from the top of the exit of the diffraction slot and a lower throat surface protruding from the bottom of the exit of the diffraction slot, shaped to match its interface to the diffraction slot, where the slope of the upper throat surface and the slope of the lower throat surface are dimensioned to maintain the surface area of the wavefronts of acoustic pressure waves at the predetermined target frequency to be constant at each distance the wavefronts progress through the throat region, and the throat region narrows in a vertical dimension towards its opposite end.

In a still further embodiment again, the baffle face is sealed to the speaker driver such that the diffraction slot forms a path for substantially all acoustic pressure of the audio pressure waves to emanate from the speaker driver.

In still another embodiment again, the throat region is shaped to compress an acoustic pressure wave from the speaker driver in the vertical direction and expand the acoustic pressure wave in the horizontal direction.

In a still further additional embodiment, the diffraction baffle also includes a phase plug positioned in the diffraction slot, where the phase plug provides multiple channels from its rear surface facing the speaker driver that converge at the exit of the diffraction slot on the front surface.

In still another additional embodiment, the phase plug provides two rectangular channels that converge to a rectangular diffraction slot.

In a yet further embodiment again, the rear surface of the phase plug is shaped to conform to the center cone portion of the speaker driver.

In yet another embodiment again, the diffraction baffle also includes an adaptor portion positioned between the speaker driver and the diffraction slot, where the adaptor portion includes a constant transition surface shaped at the interface to the diffraction slot to match the shape of the entrance to the diffraction slot and shaped circular at its opposite end facing the speaker driver, and shaped to maintain a constant cross-sectional area in planes parallel to the orientation of the speaker driver.

In a yet further additional embodiment, the diffraction slot and the curvature of the throat region thereby shape acoustic pressure waves at and lower than the predetermined target frequency generated by the speaker driver and passing through the diffraction slot to radiate in a pattern wider than they were before passing through the diffraction slot and to radiate in a pattern greater than 120 degrees.

In yet another additional embodiment, the diffraction slot is rectangular.

In a further additional embodiment again, the diffraction slot is round.

In another additional embodiment again, the diffraction baffle also includes an upper horn flare surface joined to the upper throat surface and positioned horizontally above the diffraction slot, and a lower horn flare surface joined to the lower throat surface and positioned horizontally below the diffraction slot.

In a still yet further embodiment again, the upper horn flare surface and lower horn flare surface are flat.

In still yet another embodiment again, the upper horn flare surface and the lower horn flare surface are shaped with an exponential curvature.

In a still yet further additional embodiment, the upper throat surface and the lower throat surface extend a distance equal to half the width of the diffraction slot.

BRIEF DESCRIPTION OF THE DRAWINGS

FIGS. 9A-9C show various examples of 180 degree low/mid frequency diffraction baffles with horn lips showing variations of the throat transition that include approximations with a ramp, approximations with steps and approximations with a hemisphere. As can readily be appreciated, many other approximations are possible.

FIGS. 11A-11C show further variations of 180 degree low/mid frequency diffraction baffles with horn shapes with "thicker", "thinner" and even "flat" horn lips that provide variations in the response of the system.

FIG. 16A shows the rear of the phase plug. FIG. 16B shows the front of the phase plug where the slits converge at the rectangular diffraction slot.

FIG. 22A shows the rear of the compression plug and phase plug slits for sound propagation. The standoff for the woofer is also shown. FIG. 22B is the same rear view but the compression plug is rotated 90 degrees for a different view of the profile of the compression plug. FIG. 22C is the front of the same system showing the approximated horns and a variation of the phase plug with an elongated tip. In this variation, the horn length is very short and the gap at the horn exit is the same as the height of the exit throat (slit height). As can readily be appreciated, many other variations are possible.

DETAILED DISCLOSURE OF THE INVENTION

Figure 1:
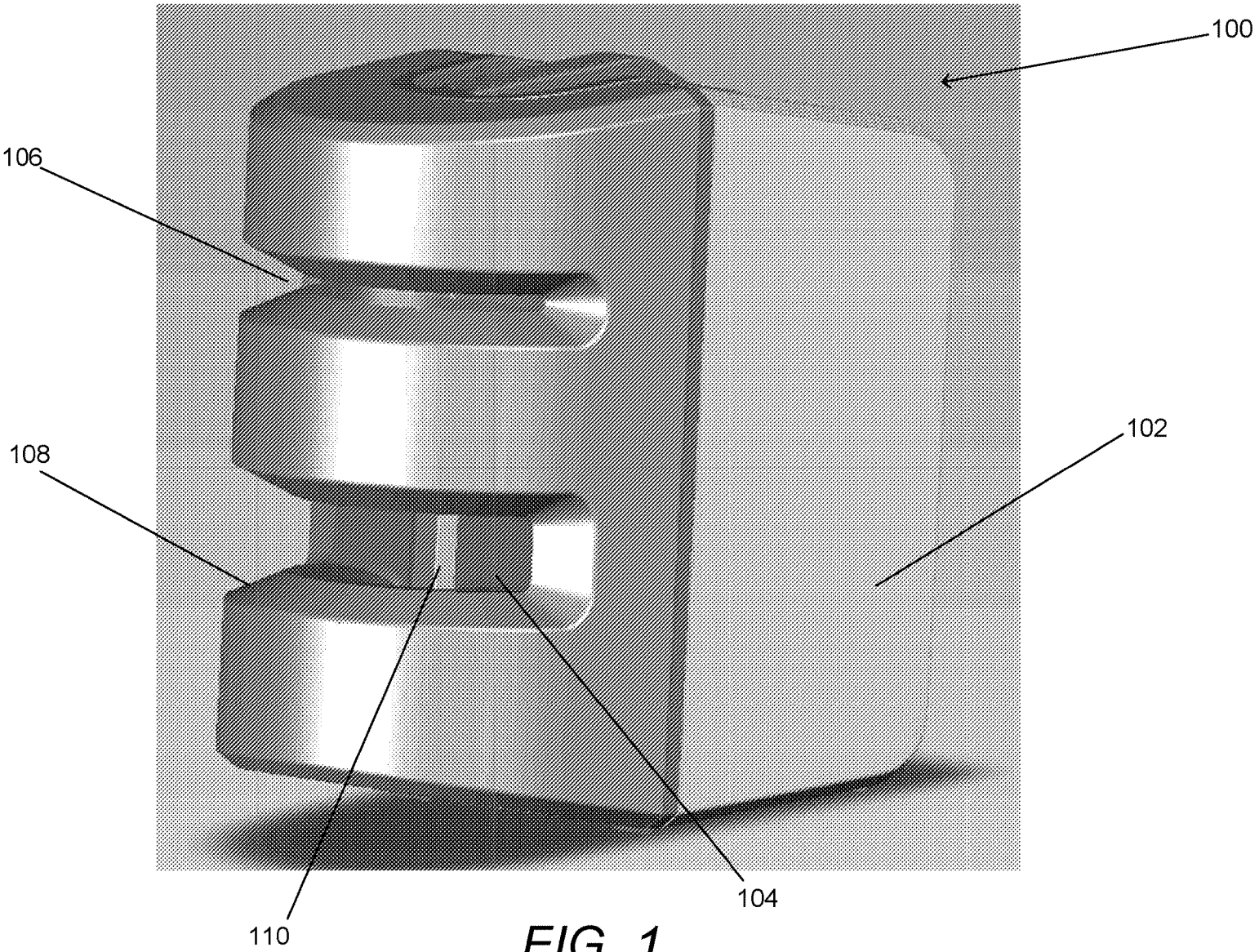
FIG. 1 is an isometric view of a speaker assembly including a 180 degree high frequency diffraction baffle with a horn and a 180 degree low/mid frequency diffraction baffle with a horn incorporating a phase plug in accordance with an embodiment of the invention.
Figure 2:
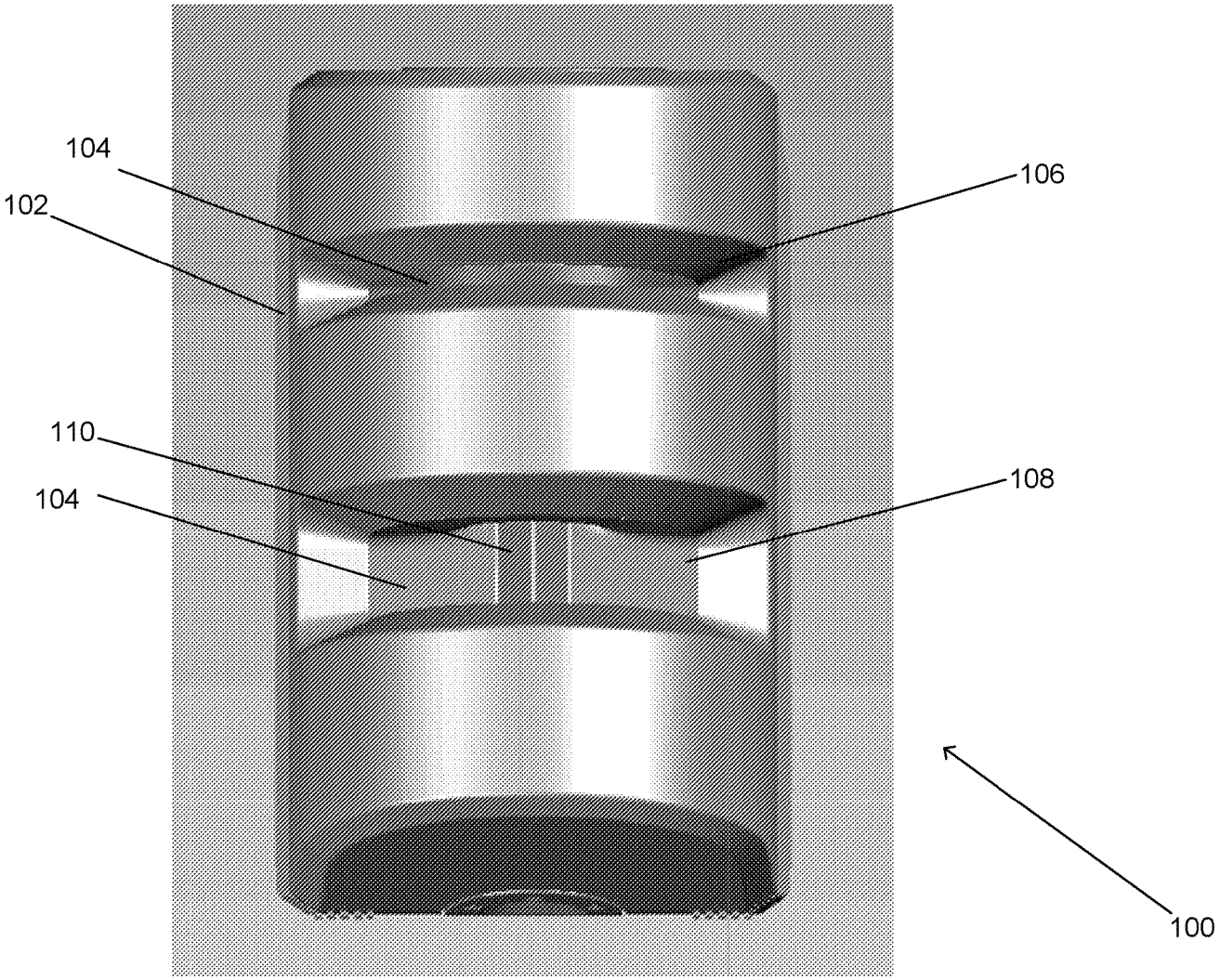
FIG. 2 is a front view of the assembly of FIG. 1.

Turning now to the drawings, speaker assemblies and methods of audio production that generate wide dispersion patterns using a diffraction baffle in accordance with various embodiments of the invention are illustrated. In many embodiments, the speaker assembly includes one or more diffraction baffles with a baffle face having an opening, referred to as a diffraction slot, positioned over the corresponding speaker driver where substantially all of the audio energy (i.e., air pressure) generated from the front of the speaker driver exits through the opening in the diffraction baffle. In several embodiments, the surrounding surfaces of the diffraction slot are sealed to the areas surrounding the speaker driver to ensure that the air pressure must exit through the diffraction slot. In some embodiments, the opening is the exit of a phase plug portion of the diffraction baffle. The diffraction slot may be shaped as a rectangle, square, circle, oval, or other shape as appropriate to the particular application. In several embodiments discussed below, the diffraction slot is rectangular with a greater height dimension than width dimension.

When a wave passes through an opening in a barrier where the opening has a dimension greater than the wavelength, the wave typically passes directly through. When the opening has a dimension equal to or smaller than the wavelength, the wavefront typically expands into an almost semicircular shape in the direction of that dimension. The portion of the wavefront closest to the edge of the opening rotates to become orthogonal or nearly orthogonal to the surface of the barrier at the exit of the opening before the wavefront progresses further outward way from the opening. This expansion and change in shape of a wavefront can be referred to as diffraction. In many embodiments, a baffle face includes a diffraction slot having a first dimension equal to or smaller than the wavelength of a wave having a predetermined target frequency and a second dimension larger than the wavelength of a wave having the predetermined target frequency. The wavefront of a wave having a wavelength equal to or smaller than first dimension travelling through the slot can be modeled as a cylindrical surface at various distances progressing from the exit of the slot.

In several embodiments, a throat region at the exit of the slot includes a first throat surface and a second throat surface that bound the second dimension at the exit. By shaping the first throat surface and second throat surface to maintain the surface area of the wavefront as it progresses and expands away from the slot, the integrity of the wavefront can be preserved, which improves the dispersion and sound quality particularly of audio signals. Many embodiments provide for effectively a greater than 120 degree dispersion of audio, while embodiments can provide for up to 180 degree dispersion. Although several embodiments discussed below includes two throat surfaces, any of a number of throat surfaces and shapes of throat surfaces may be utilized to shape a wavefront progressing out of a diffraction slot in accordance with embodiments of the invention.

Speaker drivers can include tweeters, mid-range drivers, and/or woofers as appropriate to a particular application. In several embodiments, the speaker assembly incorporates a dual-baffle system driven by a tweeter and a woofer. Further embodiments include one or more phase plugs each positioned in front of a driver. The term woofer refers to a driver designed to generate low and/or mid-frequency sounds and a tweeter is a speaker designed to generate high-frequency sounds. Speakers that incorporate two drivers and crossover circuitry to provide each drive with an appropriate frequency range are often referred to as two-way speakers. In a number of embodiments, the speaker assemblies incorporate a single driver or may include three or more drivers.

In a number of embodiments, the tweeter utilizes a compression driver. In several embodiments, the tweeter is a direct radiating tweeter such as (but not limited to) a dome tweeter. In several embodiments the tweeter drives a wide dispersion diffraction baffle having a radius sufficiently large to support frequencies at the lower end of the operating frequency range of the tweeter. In many embodiments, the throat of the diffraction baffle is configured to shape planar waves driven into the diffraction baffle by the tweeter to produce a cylindrical wavefront. In further embodiments, the cylindrical wavefront is provided to a horn region of the diffraction baffle that expands exponentially. Shaping the wavefront in this way can increase the horizontal dispersion pattern of the diffraction baffle. Wavefront shaping in accordance with various embodiments of the invention is discussed further below. Although many of the horns described herein include exponential flares, horns having any of a variety of flares can be utilized in any of the embodiments described herein. Accordingly, the invention should not be limited to any specific horn flare configuration or class of horn flare configurations. In addition, some embodiments of a diffraction baffle do not utilize a horn. That is, a baffle face attached to and positioned over the compression driver is formed with a diffraction slot, but without horn elements that further interact with or influence waves emanating from the tweeter.

In several embodiments, the woofer utilizes a compression driver. In certain embodiments, the woofer diffraction baffle is configured to act as a direct radiator below the cutoff frequency of the diffraction baffle and is driven by the low/mid frequency driver of the woofer above the cutoff frequency. In this way, the length of the flare of the horn of the diffraction baffle (i.e. the distance from the throat of the horn to the lips or mouth of the horn) can be reduced relative to a horn that is driven by the low/mid frequency driver across the entire operating frequency range of the low/mid frequency compression driver. Reducing the form factor of the horn results in a speaker assembly that has a wide dispersion pattern in a much smaller form factor than typical wide dispersion factor loudspeakers and studio monitors. At higher frequencies, the low/mid frequency diffraction baffle achieves a wide dispersion pattern by changing the shape of the wavefronts of acoustic pressure waves driven into the throat of the diffraction baffle in a similar manner to that described above with respect to the tweeter diffraction baffle. By decreasing the dimensions of the throat in a first direction (e.g. vertical) and allowing the pressure waves to expand in a second direction (e.g. horizontal), the throat can change the shape of the wavefronts of the acoustic pressure waves from planar wavefront to cylindrical wavefronts, thereby increasing the dispersion of the wavefronts as they propagate out. The wavefront can then be radiated by any of a variety of horn flares including (but not limited to) flat, linearly sloped, and/or exponentially shaped transitions from the throat of the diffraction baffle to the mouth of the horn portion. The specific flare shape used in the low/mid frequency horn typically depends upon the requirements of a given speaker assembly. In addition, some embodiments do not utilize a horn. That is, the baffle face attached to and positioned over the compression driver is formed with a diffraction slot without horn elements that further interact with or influence waves emanating from the woofer.

The operation of the woofer as a direct radiator below a specific cutoff frequency results in the woofer having an uneven frequency response. The woofer benefits from an efficiency gain above the cutoff frequency provided by the diffraction baffle. In several embodiments, the difference in efficiency between the direct radiating mode and the use of the diffraction baffle above the cutoff frequency is accommodated through the use of equalization. Frequencies below the frequency cutoff can be boosted and/or frequencies above the frequency cutoff can be attenuated. In many embodiments, the equalization applied to the signal used to drive the woofer can be described by an equalization curve that is the inverse of the efficiency gain for the diffraction baffle at frequencies above the cutoff frequency.

In a number of embodiments, the speaker assemblies utilize phase plugs. In some embodiments, phase plugs are utilized with one or both of the diffraction baffles. In other embodiments, phase plugs can be utilized without a diffraction baffle. In several embodiments, the phase plug utilized with the tweeter comprises multiple radial channels. In many embodiments the phase plug utilized in the low-mid frequency diffraction baffle is positioned close to the diaphragm of the low/mid frequency driver to achieve compression. In many embodiments, the phase plug includes multiple channels that converge in a slot with a width configured to provide wide dispersion for frequencies including the highest frequencies within the operating range of the low/mid frequency driver. As can readily be appreciated, the specific structure of a phase plug used as a mechanical interface between a driver and a diffraction baffle is largely dependent upon the requirements of a specific speaker assembly.

In many embodiments, the dual baffle of the speaker generate a horizontal dispersion pattern greater than 95 degrees. In several embodiments, dual baffles of the speaker generate a horizontal dispersion pattern greater than 100 degrees. In certain embodiments, dual baffles of the speaker generate a 180 degree horizontal dispersion pattern. In certain embodiments, a diffraction baffle of a speaker assembly in accordance with an embodiment of the invention can generate a greater than 180 degree horizontal dispersion pattern.

While much of the discussion above and below describes speakers that include two drivers in the form of a tweeter and a woofer, speaker assemblies in accordance with various embodiments of the invention can include any number of drivers including (but not limited to) a single driver, or three or more drivers. Specifically, mid-range drivers and/or additional types of speaker drivers may be utilized to produce sound of different frequency ranges from those discussed above. Speaker assemblies in accordance with various embodiments of the invention are discussed further below.

Speaker Assemblies

Turning now to FIGS. 1-4, a two-way dual diffraction baffle speaker assembly having a 180 degree dispersion pattern in accordance with an embodiment of the invention is illustrated. The speaker assembly 100 includes an enclosure 102 (often referred to as a cabinet) that contains the drivers and electronics of the speaker assembly and a front 104 or baffle face of the diffraction baffle to which the dual horns 106, 108 are integrally formed. In other embodiments, the dual horns are constructed separately and affixed to the baffle face 104. The 180 degree high frequency diffraction baffle 106 is positioned above the 180 degree low/mid frequency diffraction baffle 108. In the illustrated embodiment, the 180 degree low/mid frequency diffraction baffle 108 incorporates a phase plug 110. In other embodiments, the 180 degree low/mid frequency diffraction baffle 108 does not include a phase plug. As is discussed further below, the incorporation of a phase plug in either the low/mid or high frequency diffraction baffle can be beneficial in equalizing sound wave path lengths from the driver to the listener, to reduce the effect of cancellations and frequency response problems that can result from interfering audio waves having different path lengths. In many embodiments, acceptable sound quality can be achieved by a diffraction baffle without the use of a phase plug and/or horn.

Figure 3:
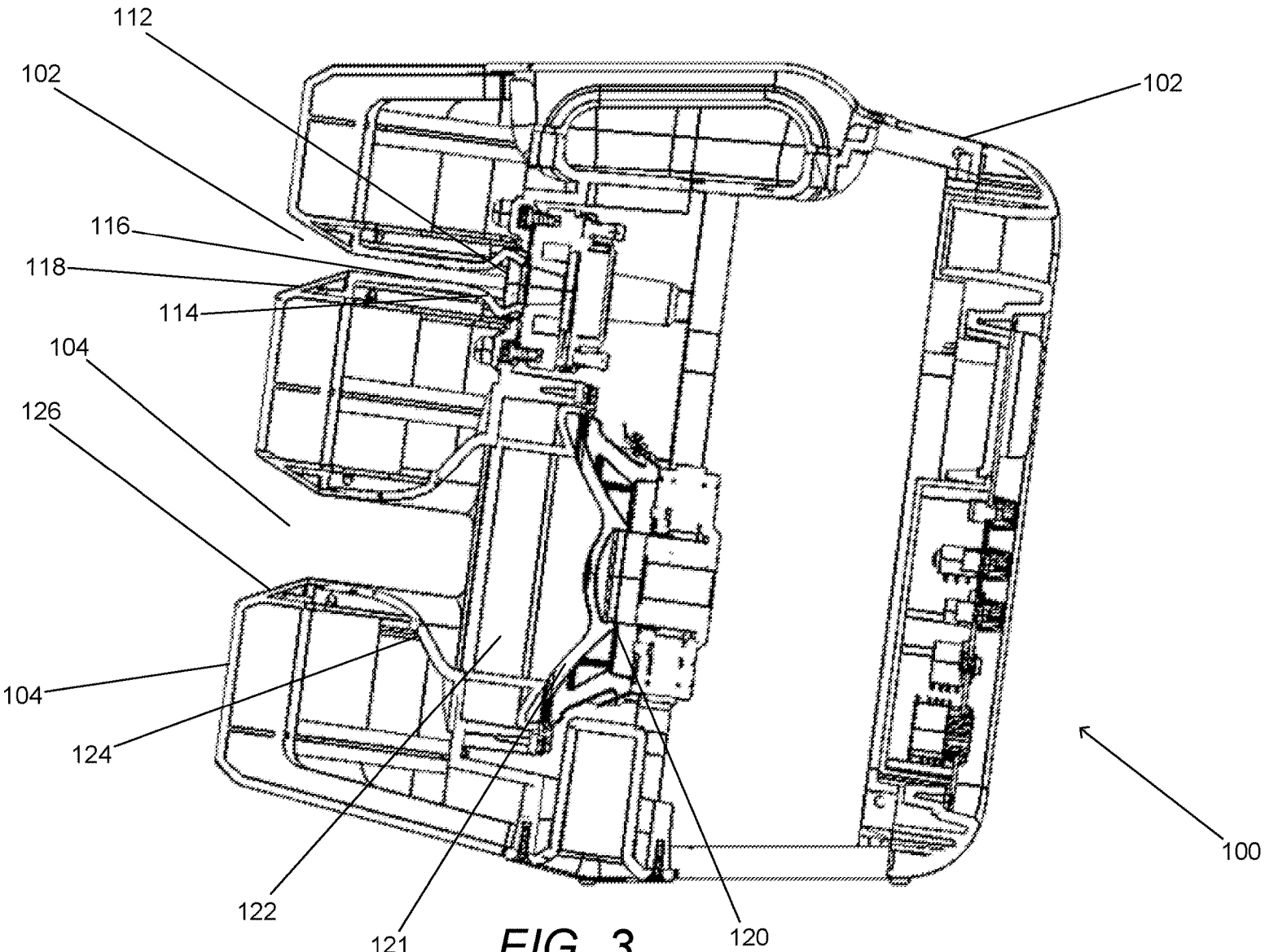
FIG. 3 is a cross-section of the assembly of FIG. 1.
Figure 4:
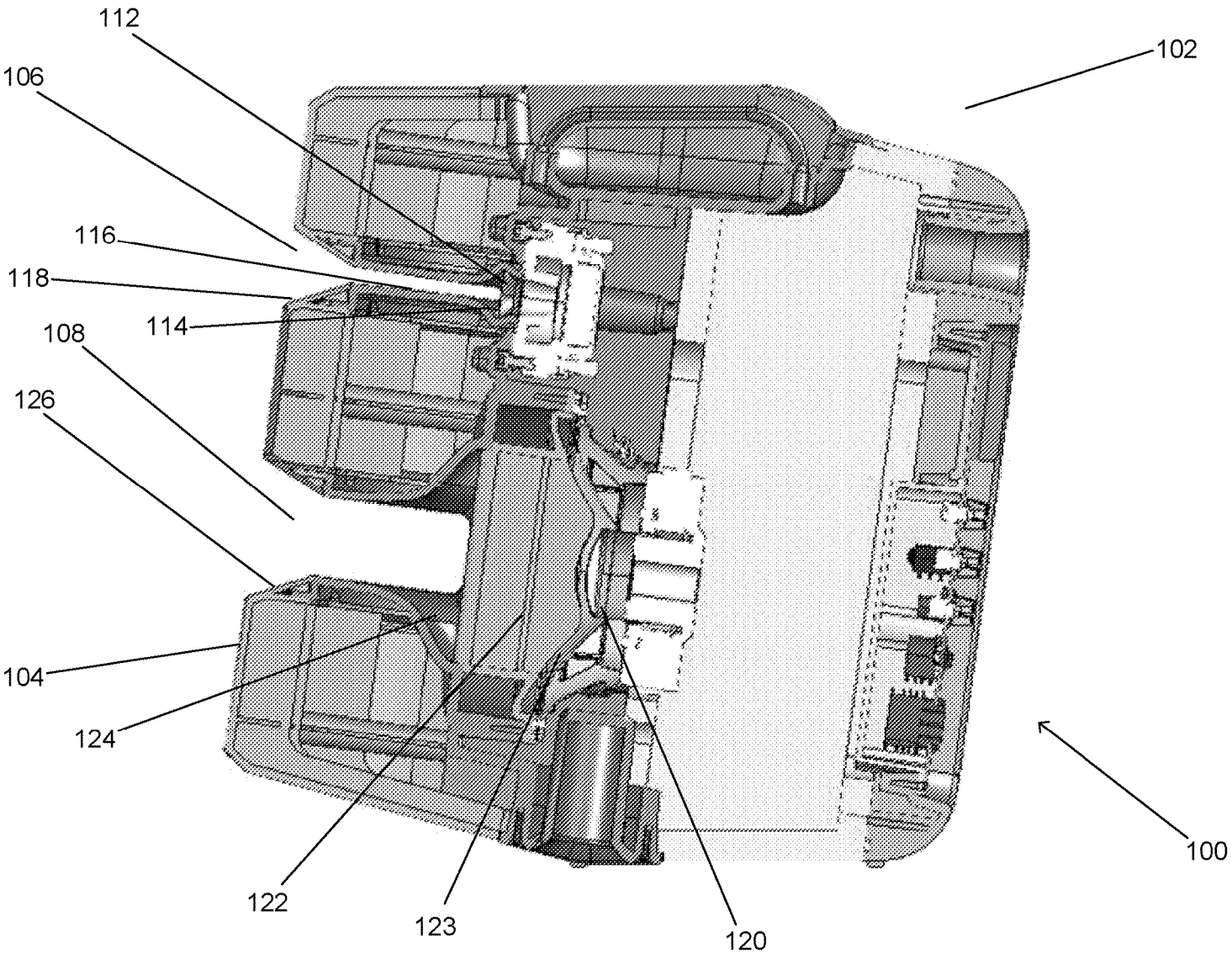
FIG. 4 is a cross-section of the assembly in FIG. 1, but not in wireframe format.
Figure 6A:
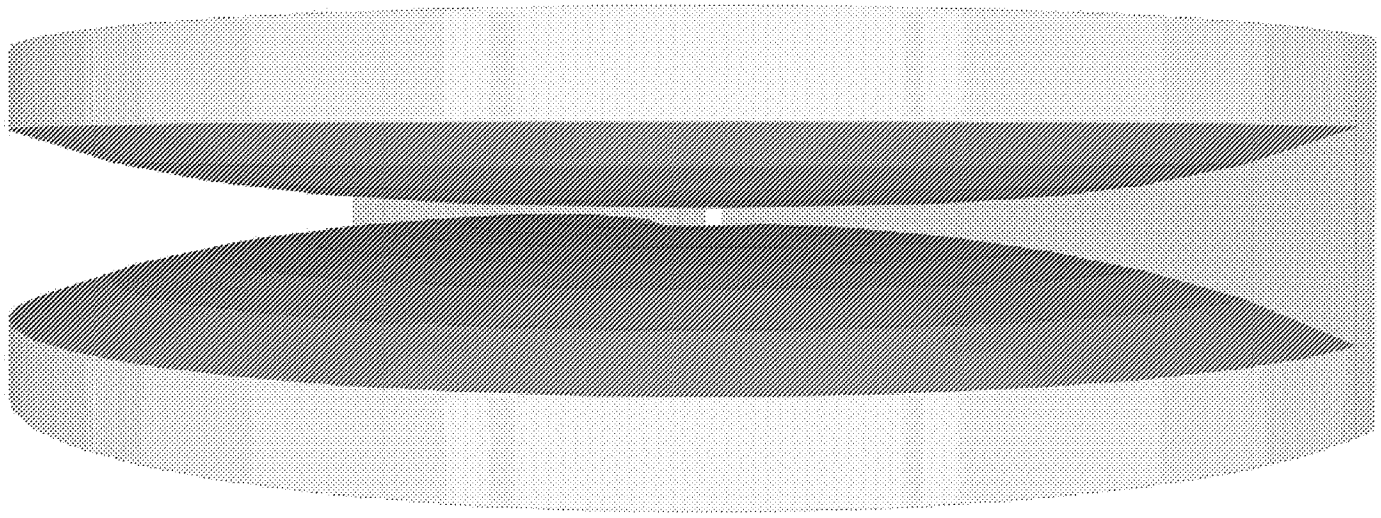
FIGS. 6A and 6*b* show a 180 degree high frequency diffraction baffle with horn including a rectangular/square cross section of the throat entrance/exit and a variation of the horn lips with a horn flare for 180 degree dispersion.
Figure 6B:
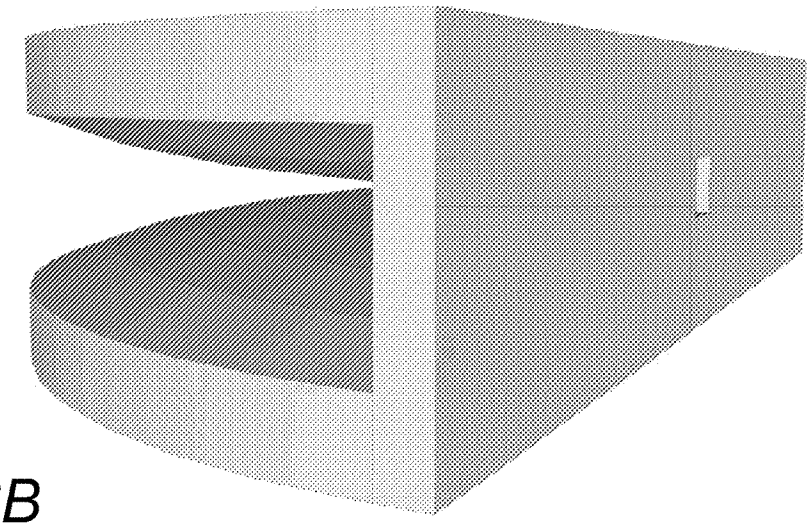
Figure 6D:
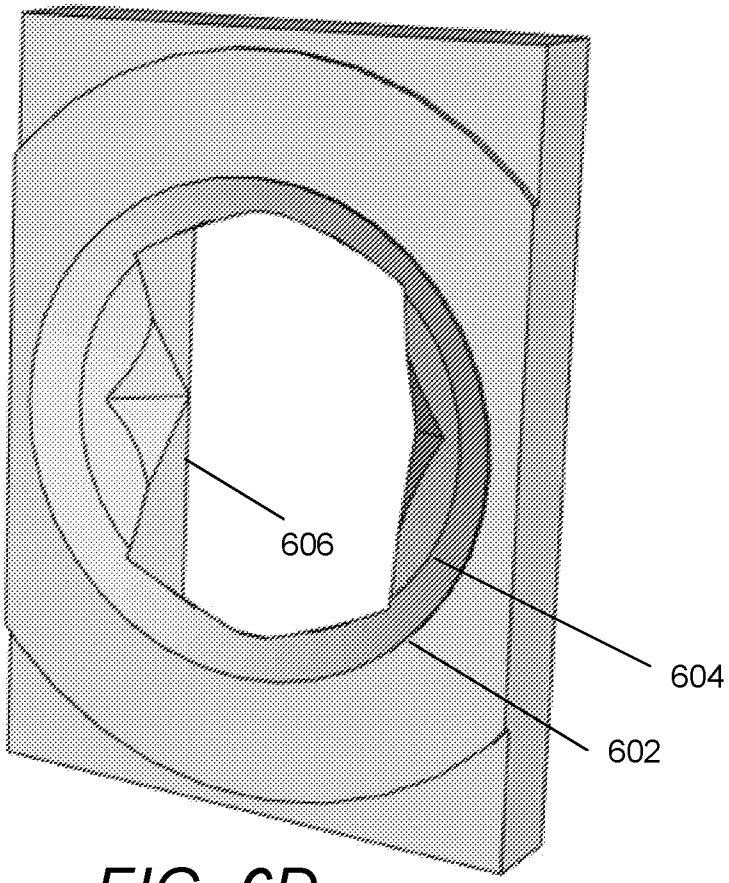
FIGS. 6C-6M conceptually illustrate various views of adaptors that can be utilized to interface a speaker driver with a diffraction slot in accordance with an embodiment of the invention.
Figure 6C:
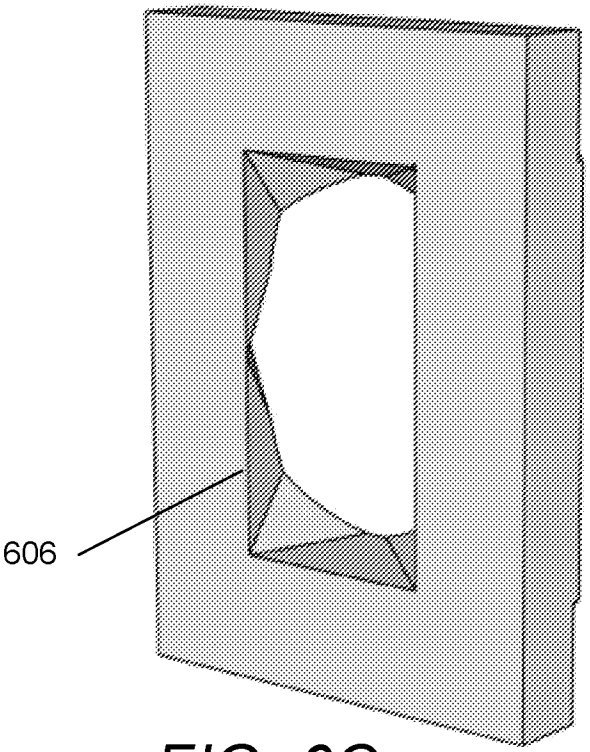
Figure 6F:
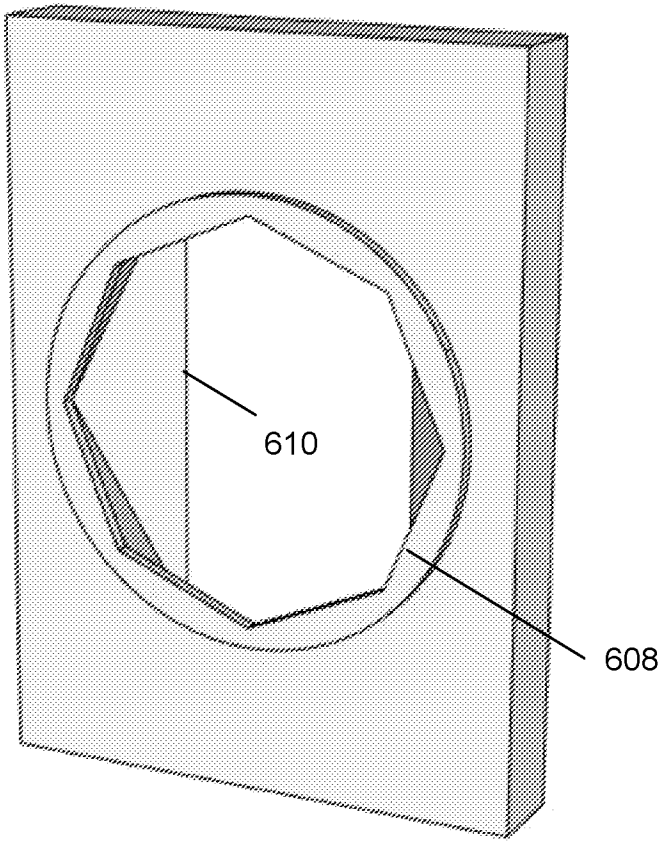
Figure 6E:
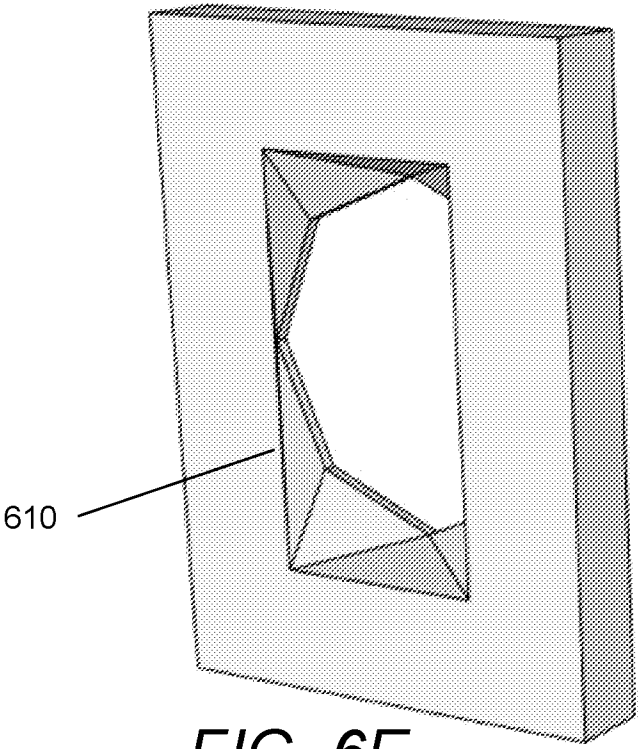
Figure 6I:
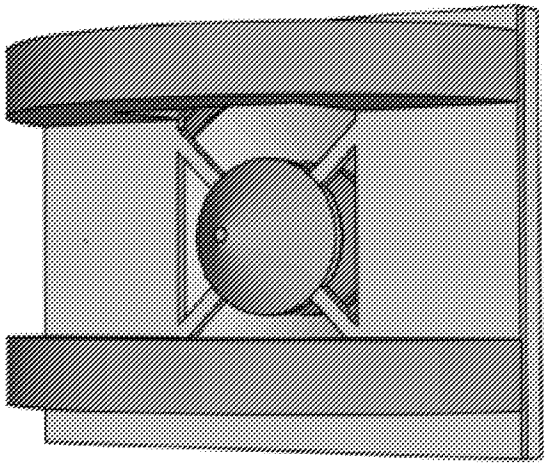
Figure 6H:
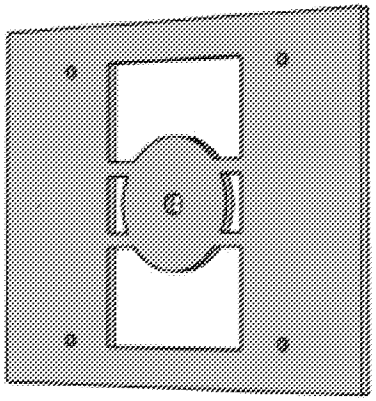
Figure 6G:
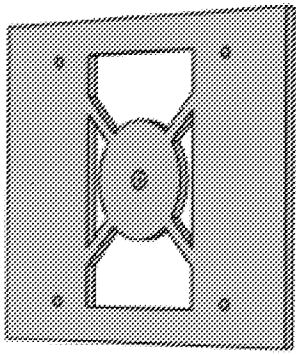
Figure 6J:
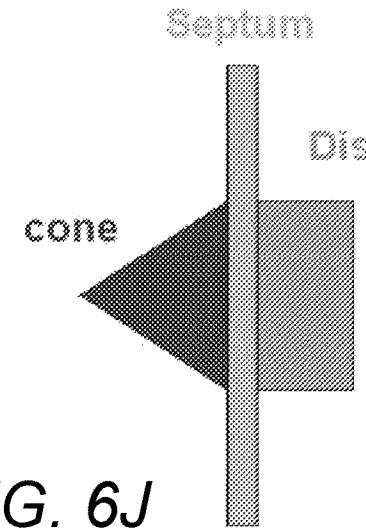
Figure 6K:
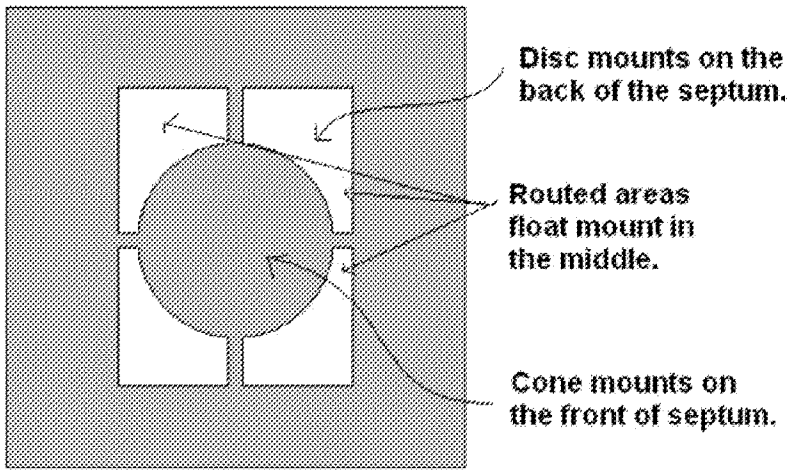
Figure 6L:
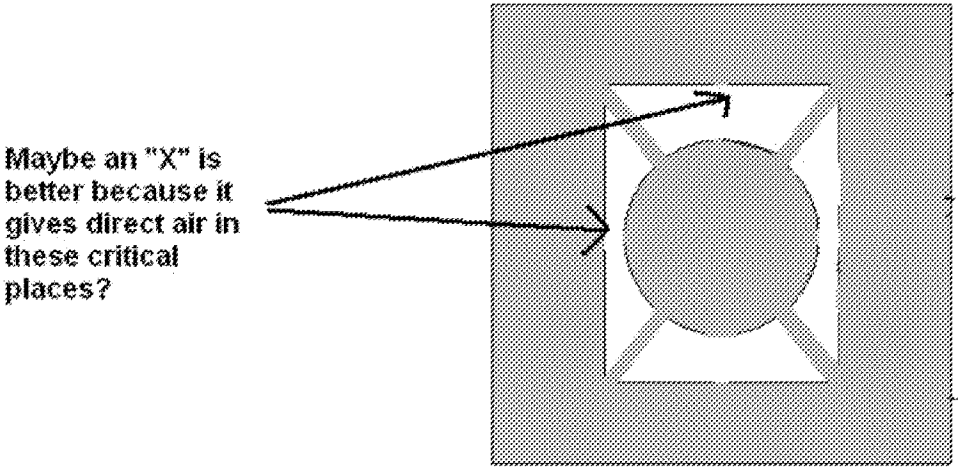

Referring specifically to the cross-sections of the speaker assembly 100 shown in FIGS. 3 and 4, the details of the speaker assembly drivers and diffraction baffles can be seen in greater detail. The 180 degree high frequency diffraction baffle 106 is driven by a tweeter 112. In the illustrated embodiment, the tweeter is a compression driver. In other embodiments, any of a variety of direct radiating high frequency drivers that may or may not utilize compression can be used to drive the high frequency diffraction baffle of the speaker assembly including (but not limited to) a dome tweeter. A common distinction between compression drivers and dome tweeters is that the vibrating member is typically stiffer in a compression driver and the compression driver incorporates a phase plug. Furthermore, compression drivers typically produce acoustic pressure waves having planar wavefronts that can be used to a feed a diffraction baffle. A dome tweeter by contrast is typically designed to work in free air and is often designed for greater excursion than is typical for a compression driver. Speaker assemblies in accordance with many embodiments of the invention can utilize dome tweeters in conjunction with diffraction baffles with entrance slits that provide little or mild non-distorting compression. In addition, speaker assemblies in accordance with various embodiments of the invention can utilize a dome tweeter in conjunction with a phase plug. Examples of various adaptors that can be utilized to interface a speaker driver with a baffle face are shown in FIGS. 6C-6M and various phase plugs that can be utilized to interface a dome tweeter and a baffle face are shown in FIGS. 6N and 6O. Similar configurations can also be utilized in three way speaker assemblies that incorporate dome midrange drivers. The adaptor illustrated in FIGS. 6C-6D includes a circular entrance 602 that narrows to a smaller radius circular section 604. This narrowing provides some amount of compression by reducing the surface area of a wavefront passing through. From the smaller radius section to the rectangular exit 606, the surfaces are shaped to change from a circular shape to a rectangular shape to match the entrance of the diffraction slot. Through the shape-changing transition section, the surface is shaped to maintain the surface area of a wavefront to be constant as it progresses. In several embodiments, the wavefront stays as a planar wave and changes its outer shape. In many embodiments, the rectangular exit is ¾" wide by 1" tall. The adaptor illustrated in FIGS. 6E-6F does not include a compression section. It includes an entrance 608 that approximates the shape of the speaker driver and a rectangular exit 610 to match the entrance of the diffraction slot. Through the shape-changing transition section, the surface is shaped to maintain the surface area of a wavefront to be constant as it progresses.

Figure 4A:
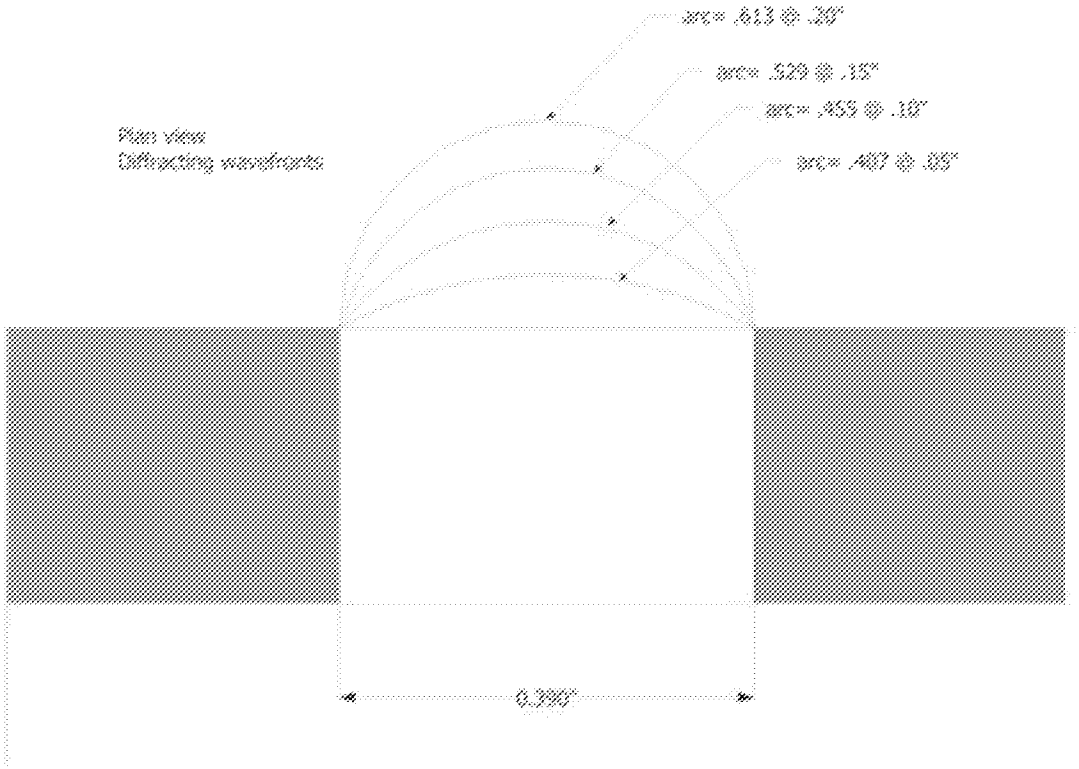
FIGS. 4A and 4B conceptually illustrate shaping of a planar wavefront in the throat of a diffraction baffle in accordance with an embodiment of the invention.
Figure 4B:
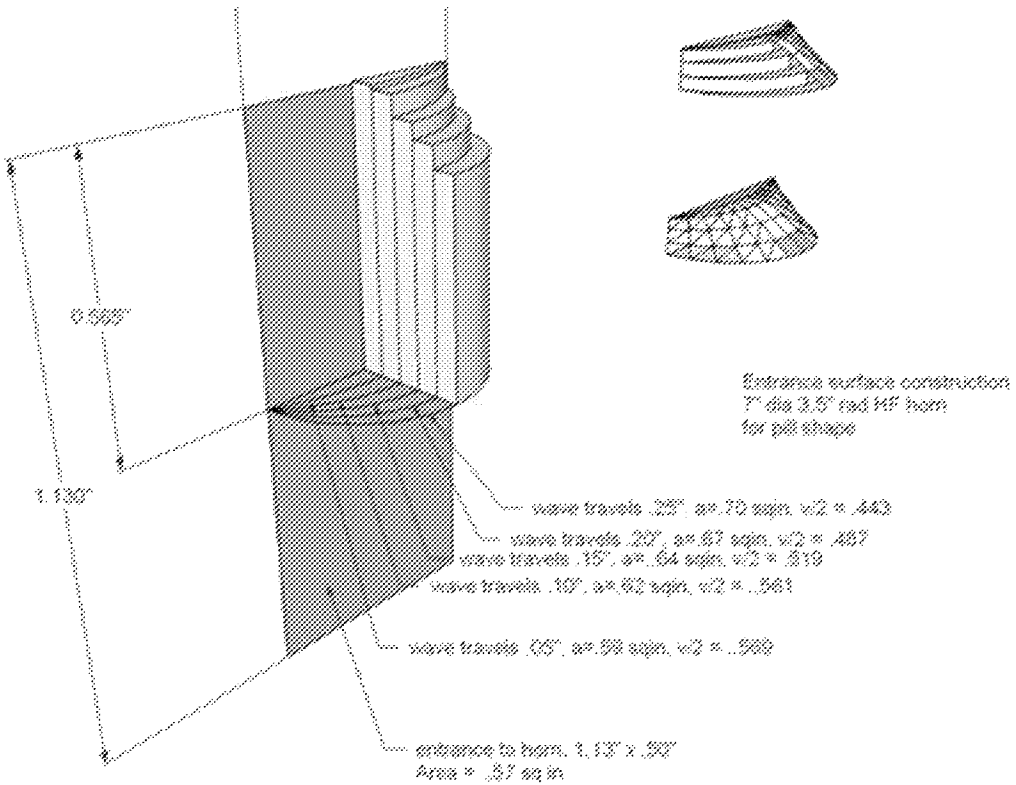

The high frequency driver directs pressure waves into an initial stage or throat of the 180 degree high frequency diffraction baffle 106. The throat 114 of the diffraction baffle narrows in a first dimension (vertical) and expands in a second dimension (horizontal). In many embodiments, the changes in the two dimensions are controlled along the throat of the diffraction baffle so that the surface area of the wavefront as it is distorted within the throat of the diffraction baffle maintains a constant surface area. Referring now to FIGS. 4A and 4B, the manner in which a wavefront can be distorted (i.e., diffracted) in the throat of a diffraction baffle as it exits the diffraction slot in accordance with various embodiments of the invention is illustrated. FIG. 4A illustrates a two-dimensional view of the shaping of a planar wavefront into a cylindrical wavefront by the diffraction slot and throat of a diffraction baffle. This cross-sectional view shows the width of the diffraction slot that is equal to or smaller than the wavelength of a predetermined target frequency. The arcs show the shape of a wavefront having a frequency at or lower than the predetermined target frequency at various distances as the wavefront progresses from the exit of the diffraction slot.

FIG. 4B illustrates in three-dimensions the manner in which the shape of the diffraction slot and throat pinches the wavefront in a first direction and shapes the wavefront in a second direction to create a cylindrical wavefront having substantially the same surface area as the planar wave entering the horn. In this way, the shape of the throat changes the shape of the wavefront of a pressure wave entering the diffraction slot so that a planar wavefront provided to the diffraction slot is compressed in the first direction and expands in a second direction increasing the dispersion of the wavefront in the second direction to create a cylindrical wavefront (i.e. a wavefront that is a section of a cylinder). The two wedges illustrate an approximated upper throat surface that bounds the wavefront as it progresses through the throat region. A lower throat surface can mirror the shape of the upper throat surface. A sloped lower throat surface according to various embodiments of the invention can be seen in FIGS. 7, 9B, 12B, and 15 as the center portion of the diffraction baffle at the exit of the diffraction slot. The cylindrical wavefront feeds the flare of the horn portion of the diffraction baffle beyond the throat, which provides a wave dispersion pattern as the wavefront propagates. Although specific throat designs are illustrated in FIGS. 4A and 4B, any of a variety of throat designs can be utilized in a diffraction baffle to shape the wavefronts of acoustic pressure waves as appropriate to the requirements of specific applications in accordance with embodiments of the invention. Furthermore, in various embodiments the waves may feed a horn portion of the diffraction baffle or the baffle may not include a horn.

Figure 6M:
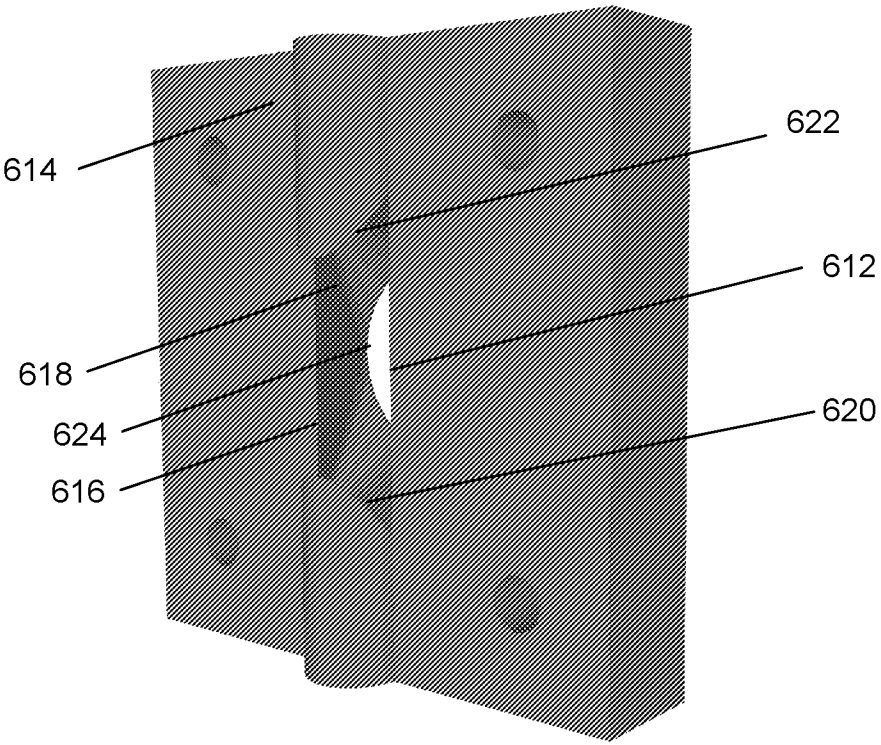
Figure 6N:
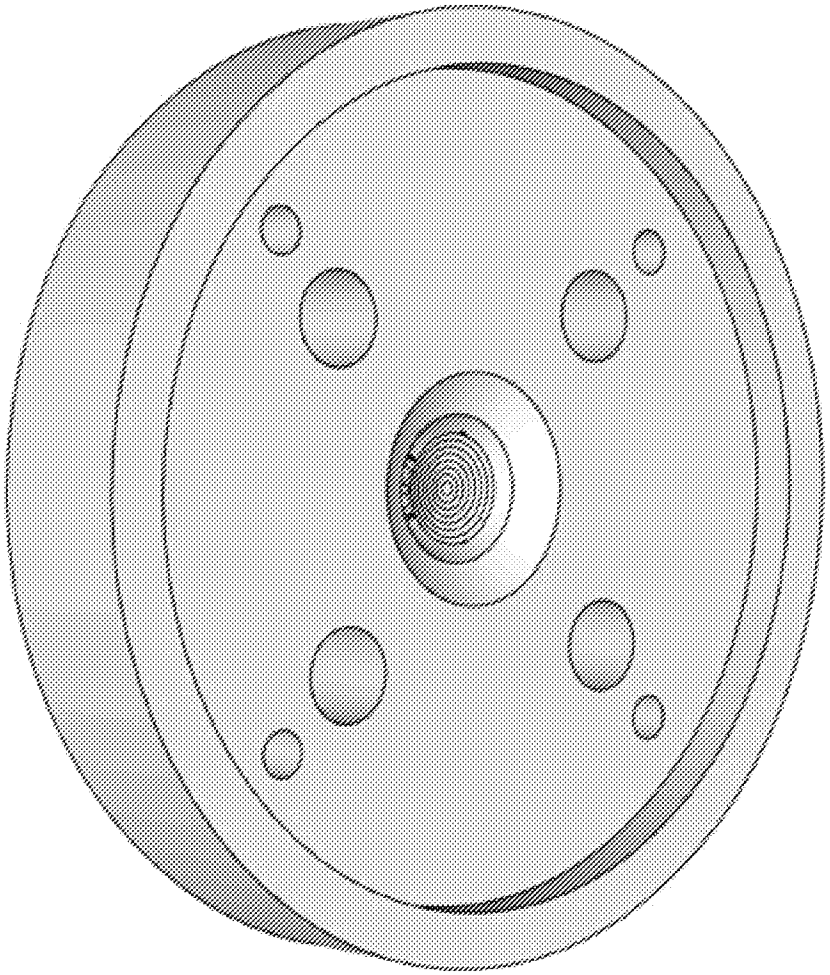
FIGS. 6N and 6O conceptually illustrate different views of a phase plug that can be utilized to interface a dome driver with a horn in accordance with an embodiment of the invention.
Figure 6O:
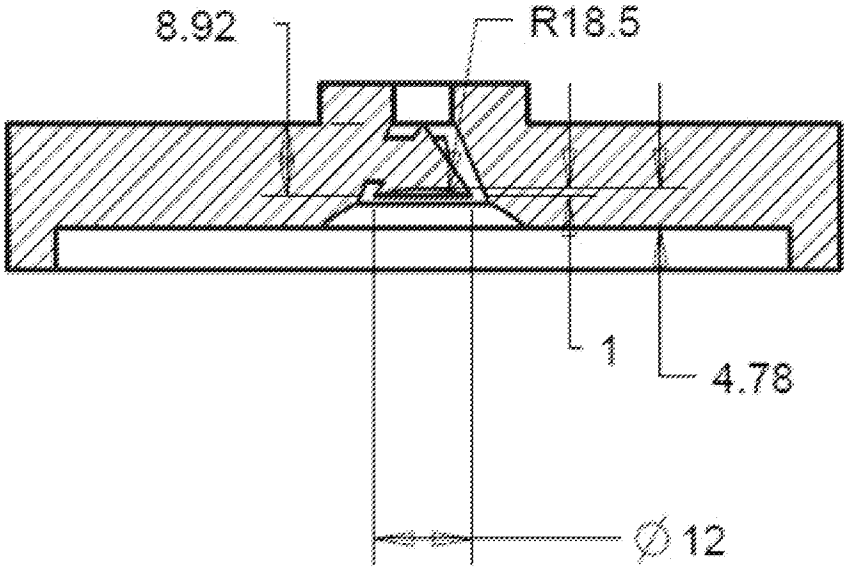
Figure 7:
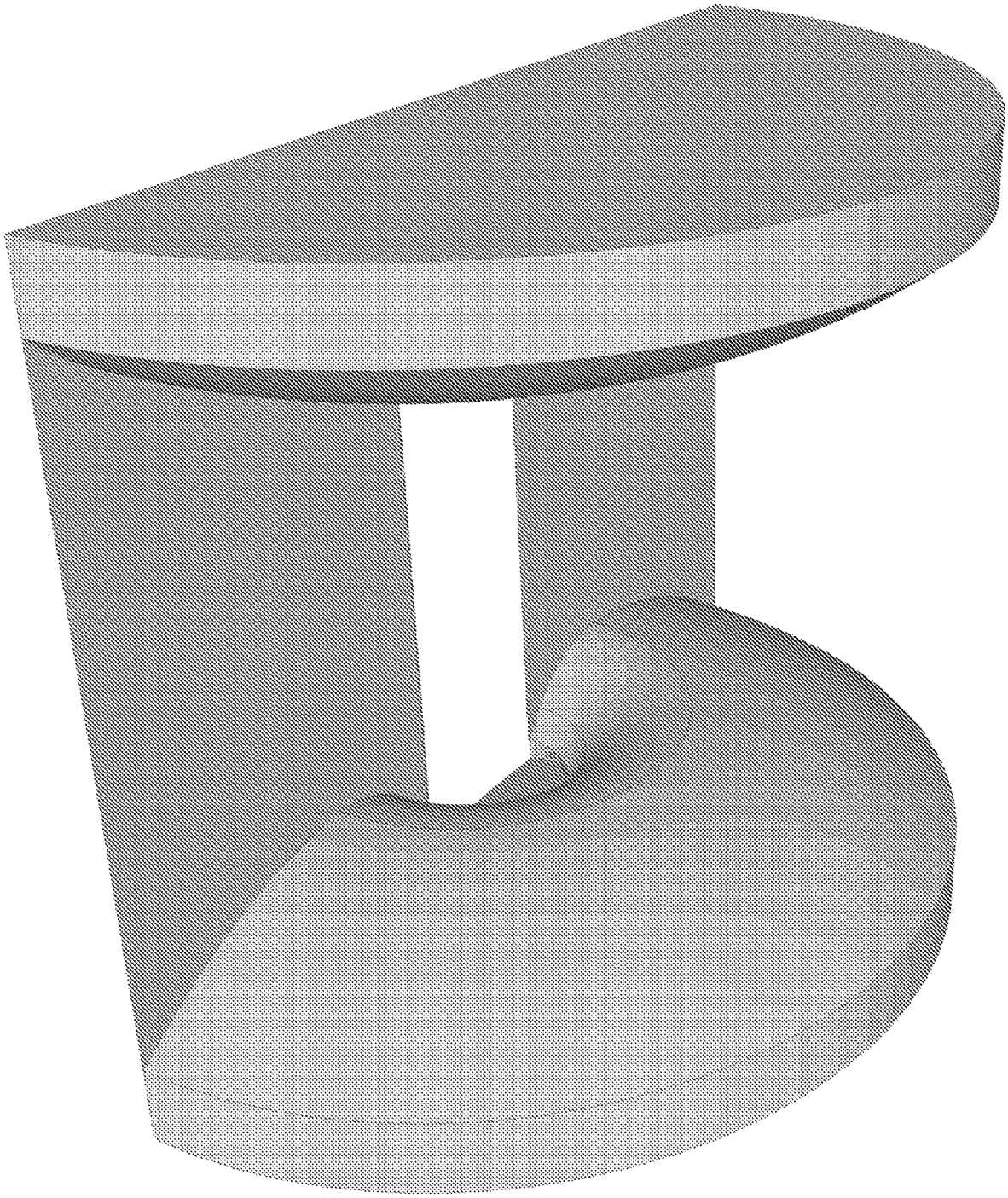
FIG. 7 shows a low/mid frequency 180 degree low/mid frequency diffraction baffle with horn including a rectangular cross section at the horn throat exit.
Figure 8B:
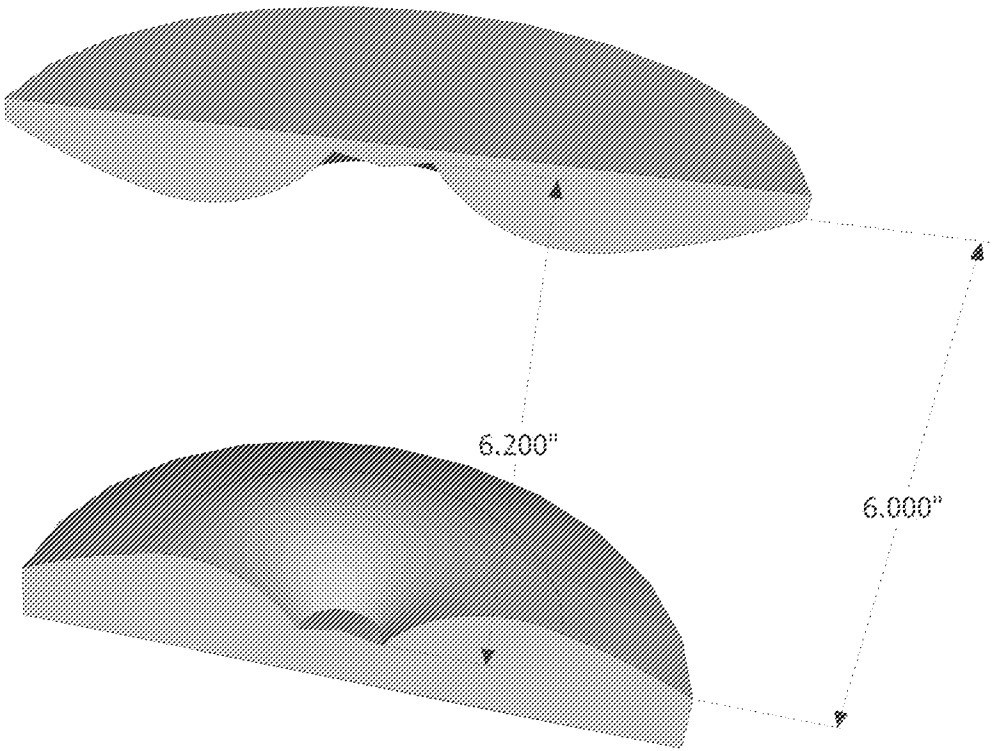
FIGS. 8A and 8B show an additional example of a 180 degree low/mid frequency diffraction baffle with horn including variations in the throat transition and horn flare from inside and outside views.
Figure 8A:
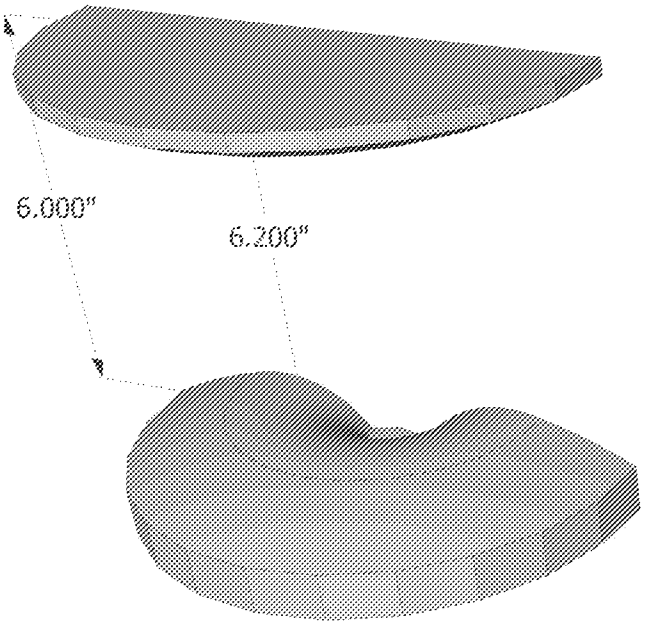
Figure 10A:
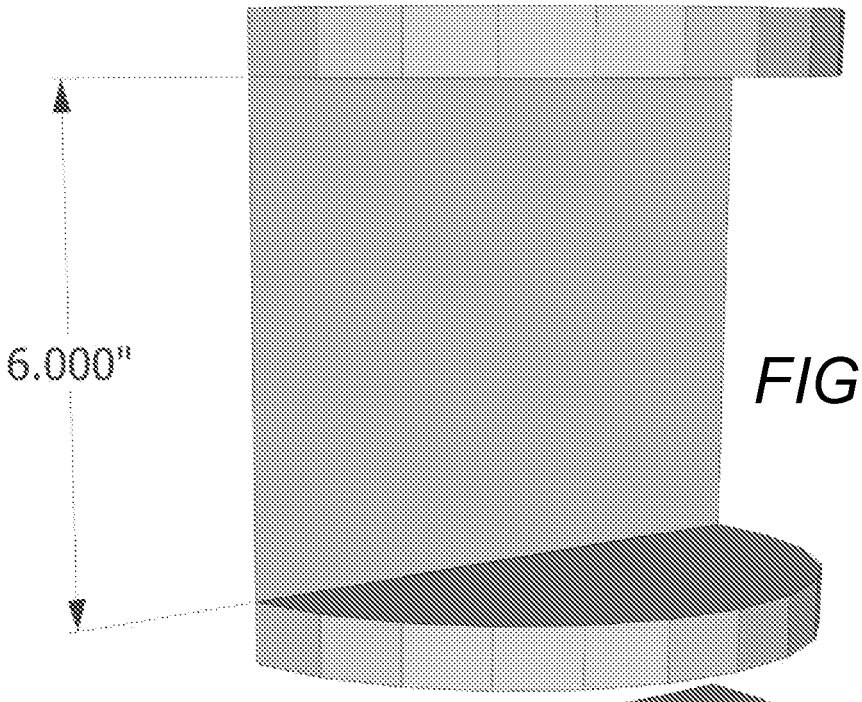
FIGS. 10A and 10B show different examples of 180 degree low/mid frequency diffraction baffles with horns that compare an approximation of flare rate (FIG. 10B) to flatted surfaces (FIG. 10A). As can readily be appreciated, many other approximations are possible.
Figure 10B:
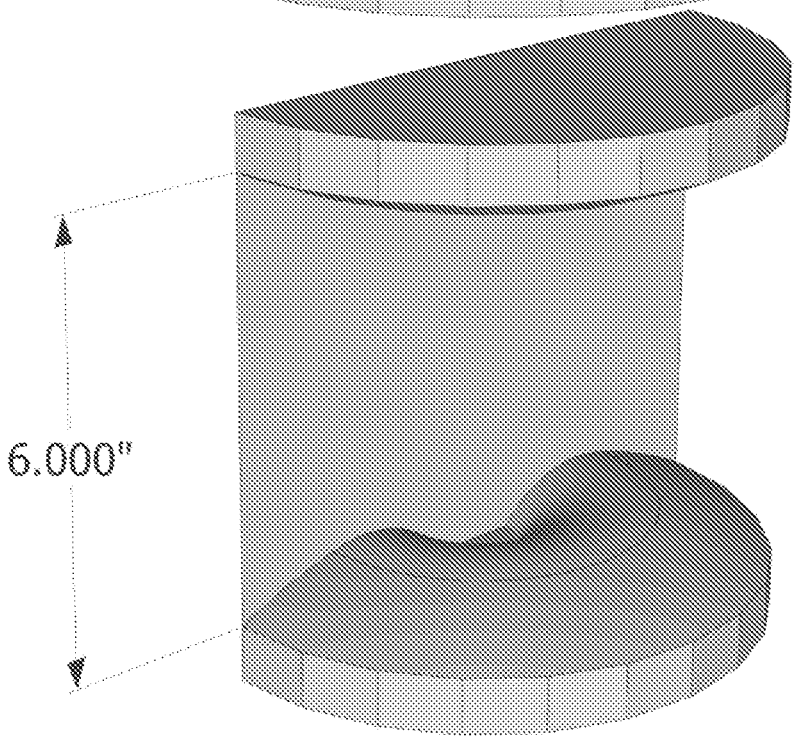
Figure 12B:
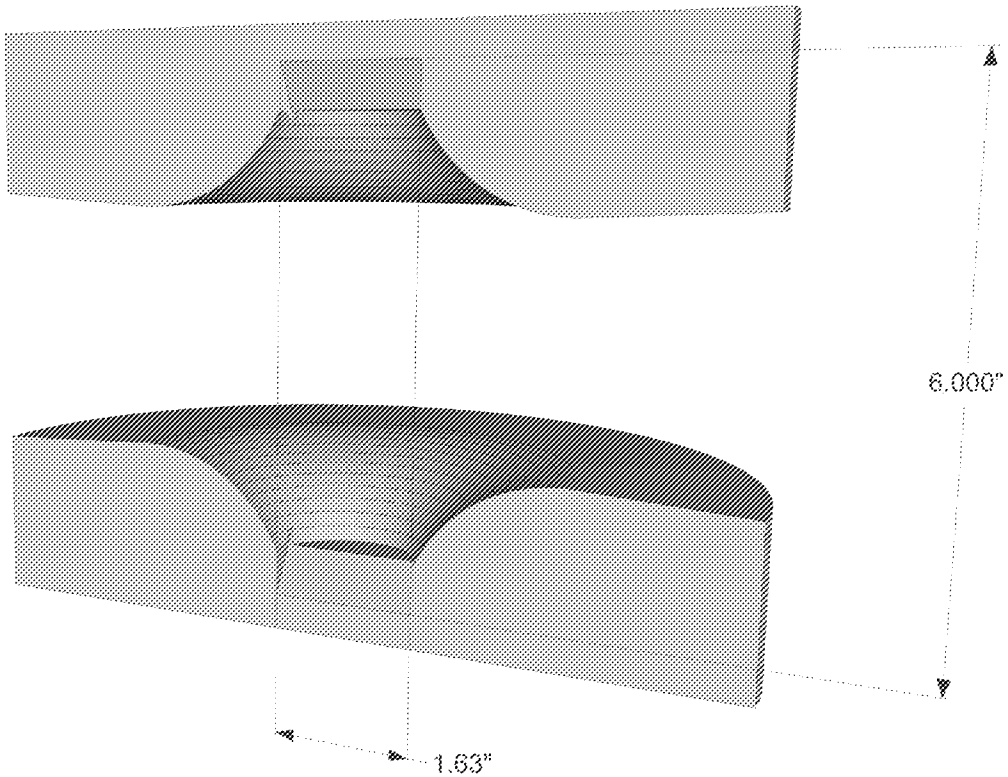
FIGS. 12A and 12B illustrate variations of the 180 degree low/mid frequency diffraction baffles with horn with narrower and wider horn exits and variations in the throat approximation.
Figure 12A:
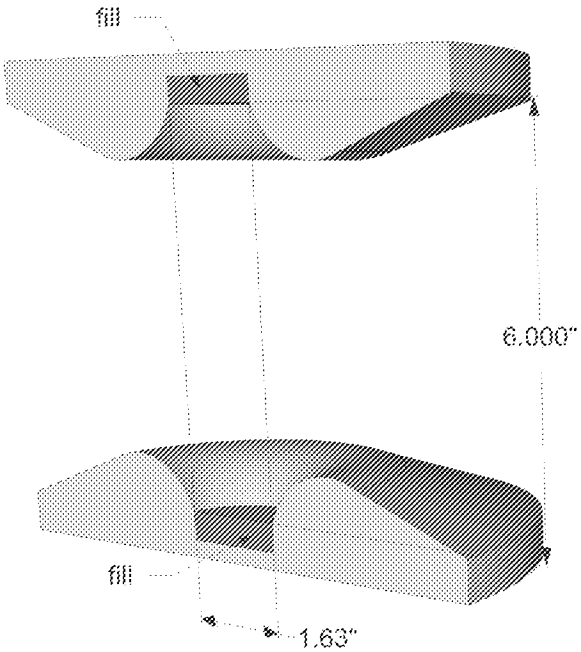
Figure 13B:
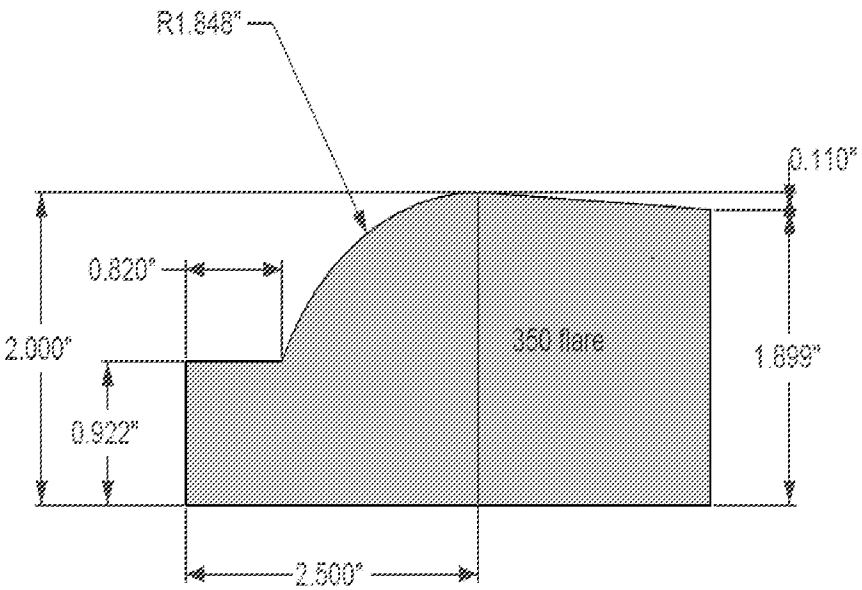
FIGS. 13A and 13B show cross-sections of the wider and narrower horn lips shown in FIGS. 12A and 12B with wider horn exits and the corresponding frequencies related to the flare rate.
Figure 13A:
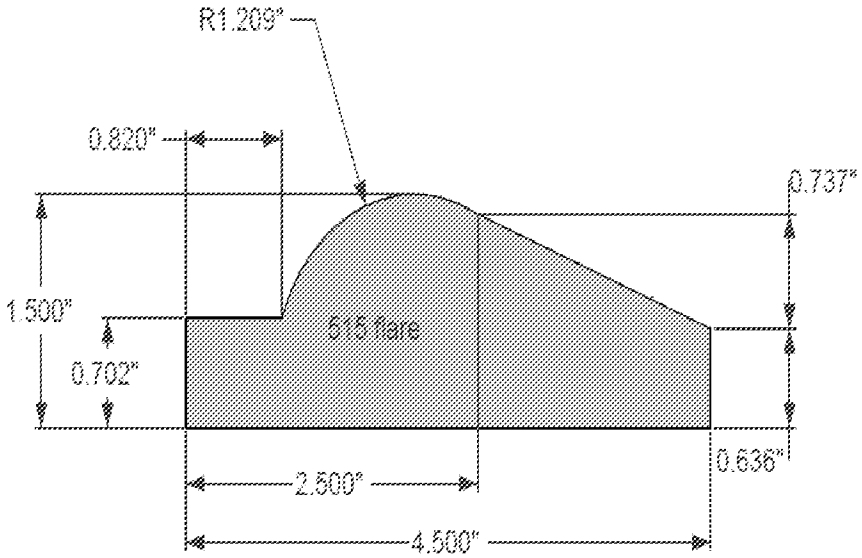
Figures 14A, 14B, 14C:
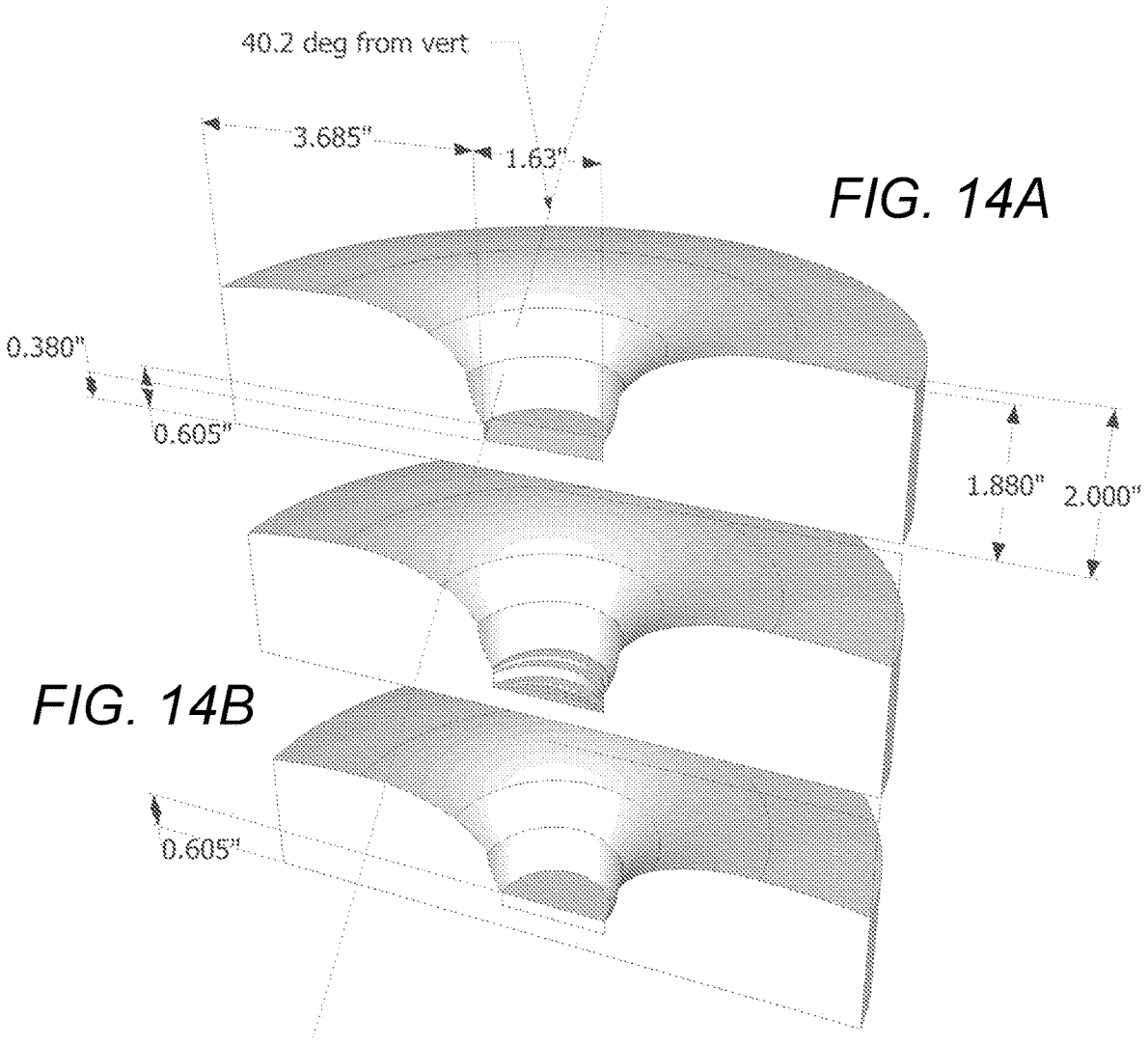
FIGS. 14A-14C illustrate throat approximation variations similar to those shown in FIGS. 9A-9C but for a "thicker lip" with a narrower horn exit and higher horn frequency.
Figure 15:
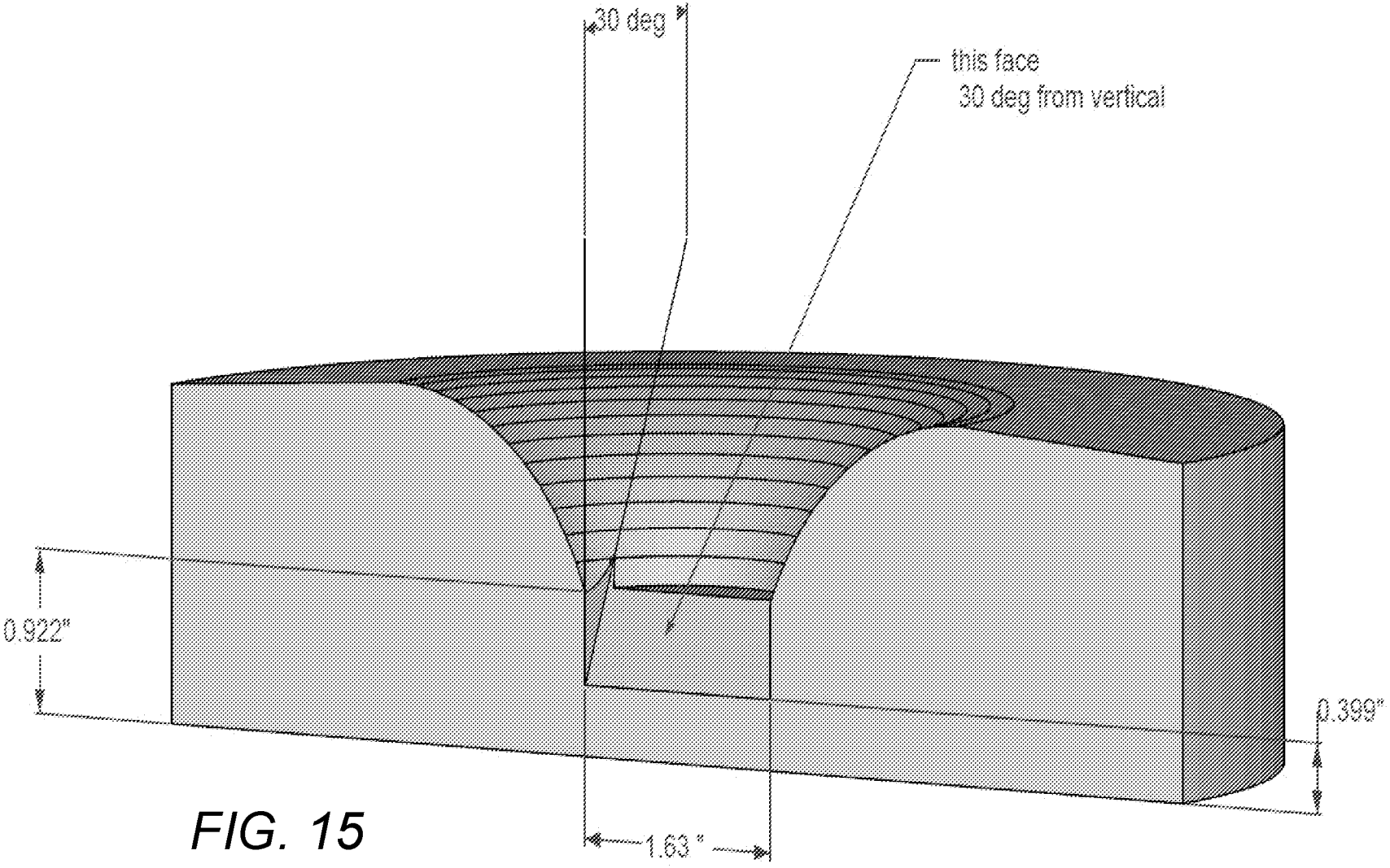
FIG. 15 is a closer view of a throat approximation similar to the throat approximation shown in FIG. 14C.
Figure 16A:
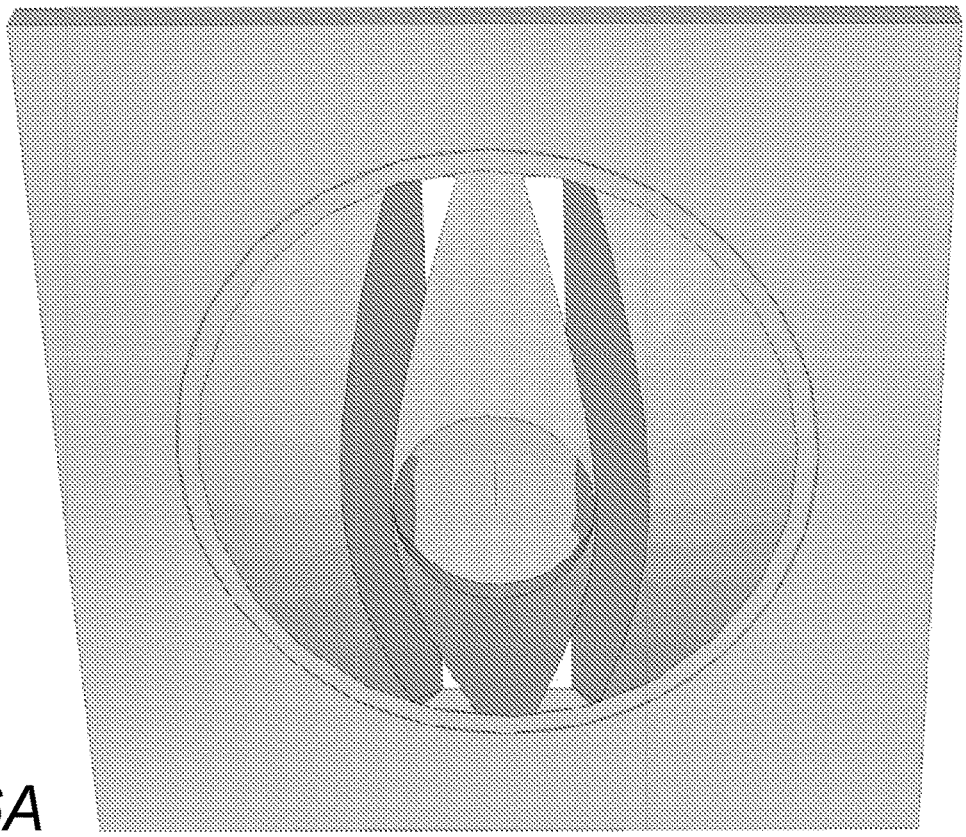
FIGS. 16A and 16B are front and back views of a low/mid frequency phase plug that is shaped to the surface of a woofer, including the nose cone of the woofer.
Figure 16B:
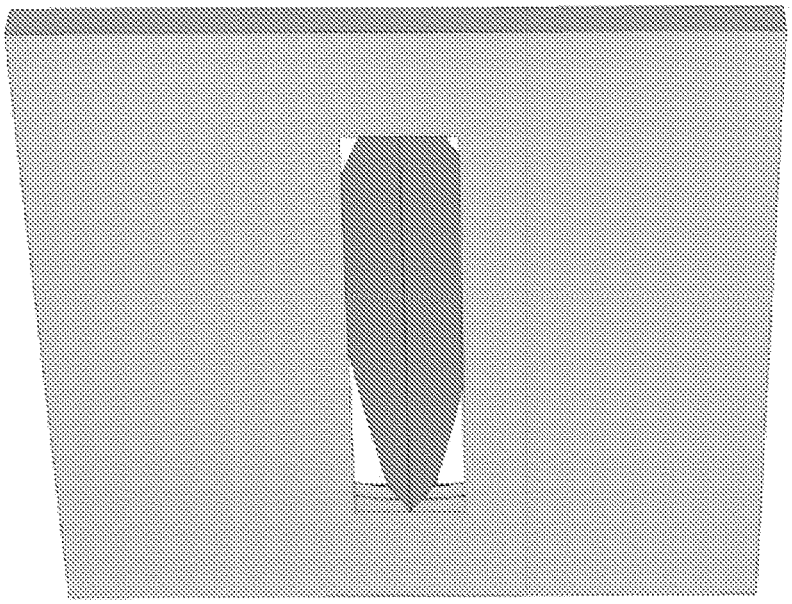
Figure 17:
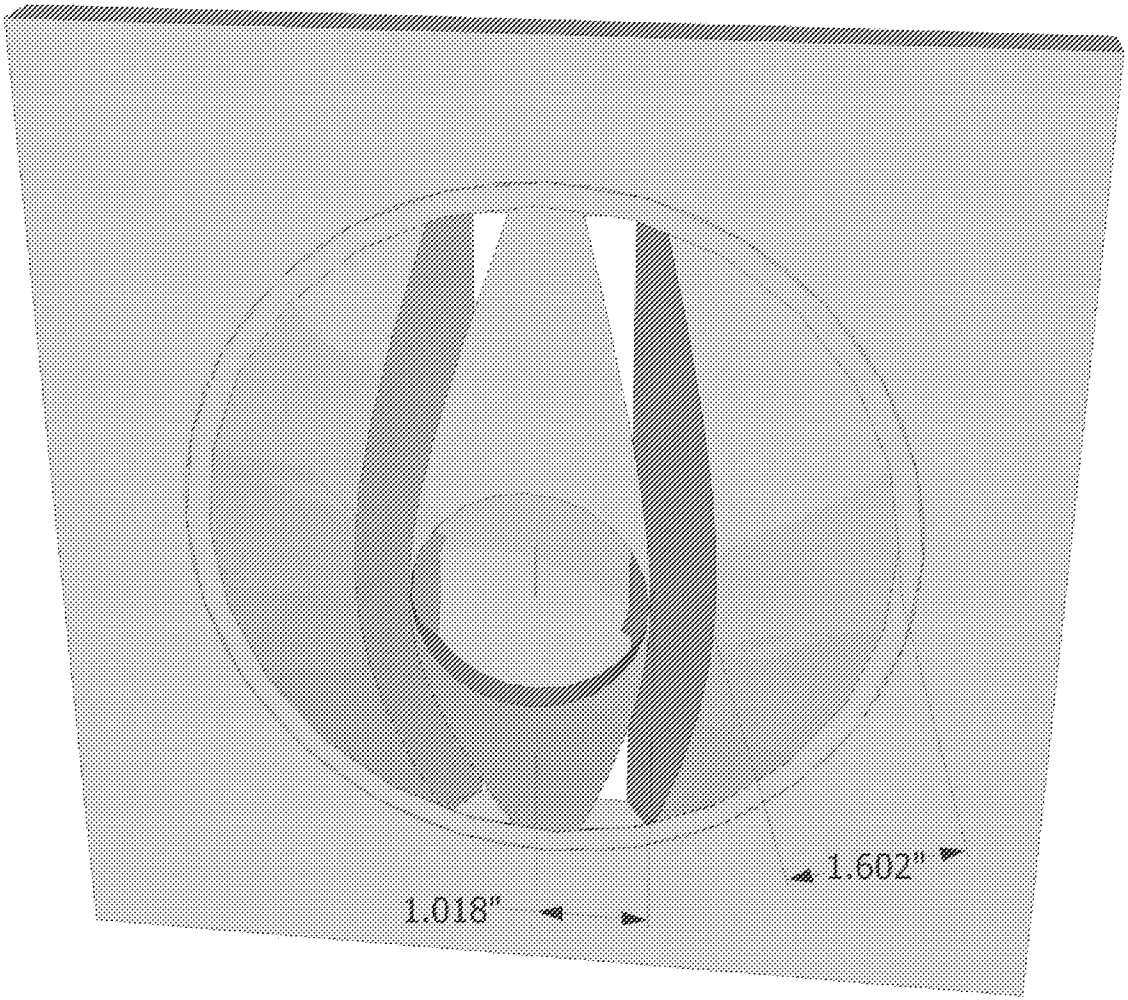
FIG. 17 illustrates the dimensions of a variation of the phase plug that shows the width of the compression areas including the rear of the phase plug.
Figure 18D:
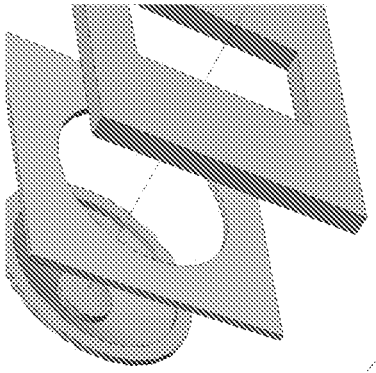
FIGS. 18A-18D conceptually illustrate a method of assembling the woofer, phase plug, and speaker gap standoff.
Figure 18C:
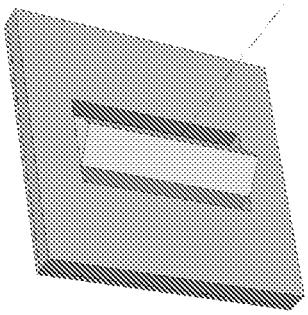
Figure 18B:
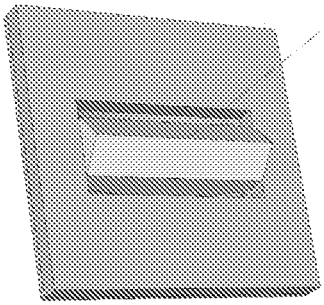
Figure 18A:
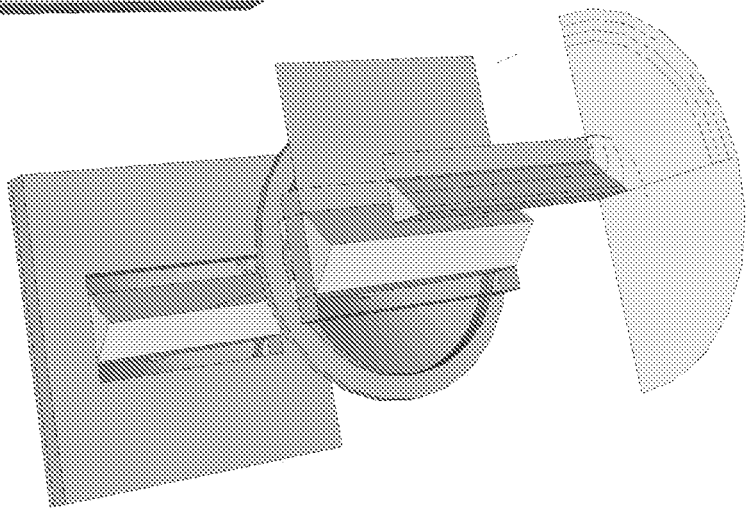
Figure 19A:
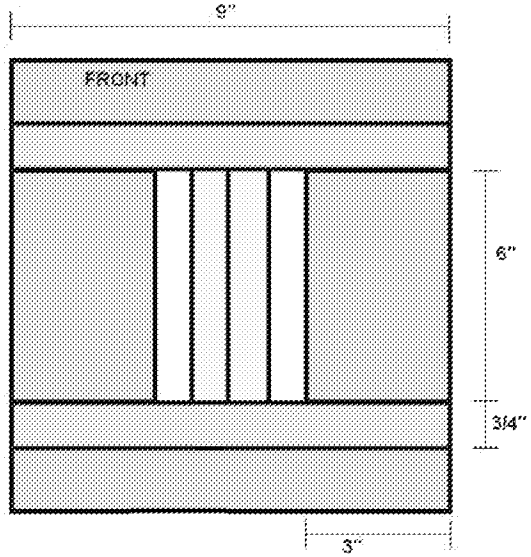
FIGS. 19A-19J are drawings showing a method of assembling a diffraction baffle that includes a low/mid frequency compression plug, woofer standoff, and low/mid frequency horn lips.
Figure 19B:
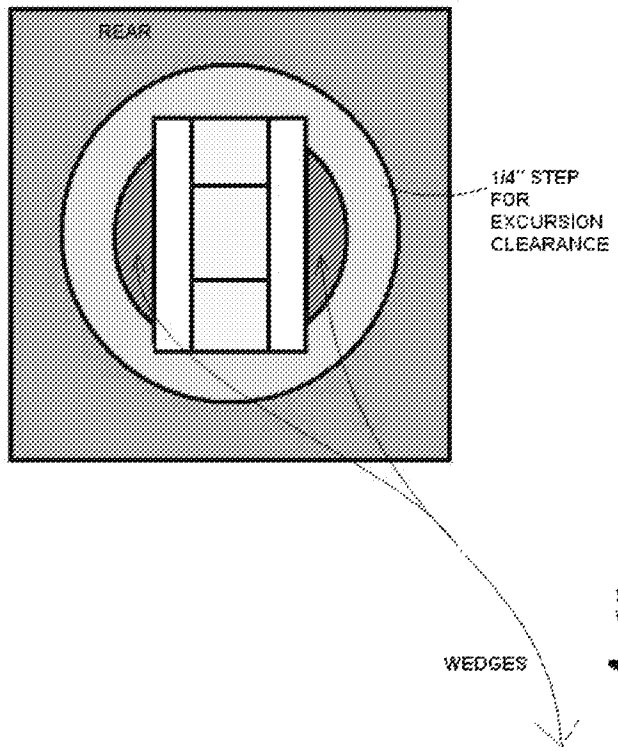
Figure 19C:
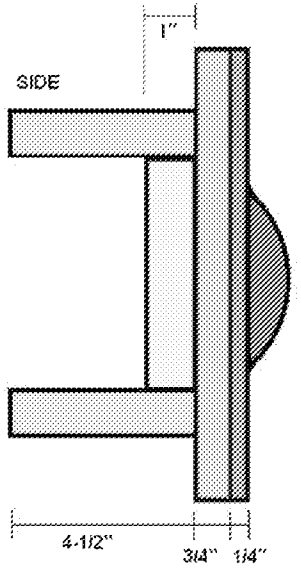
Figure 19D:
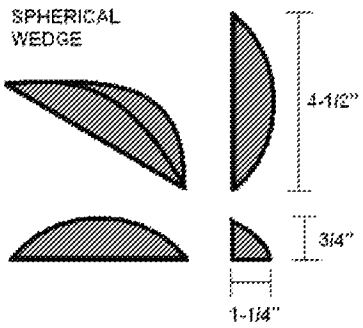
Figure 19E:
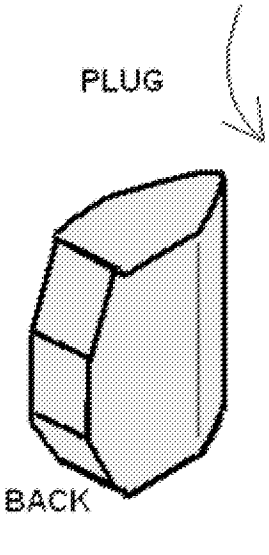
Figure 19F:
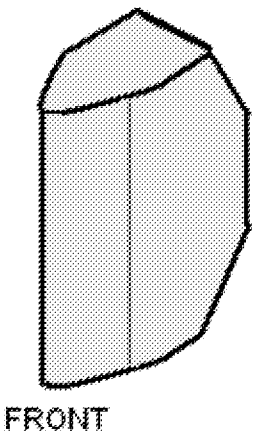
Figure 19G:
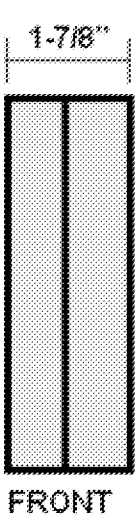
Figure 19H:
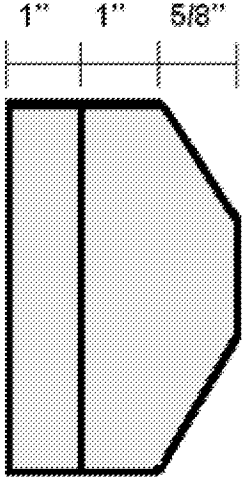
Figure 19I:
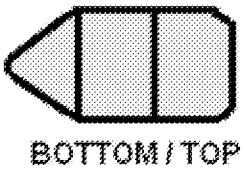
Figure 19J:
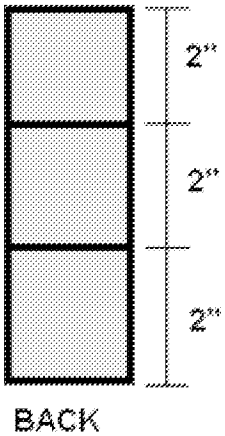
Figure 20B:
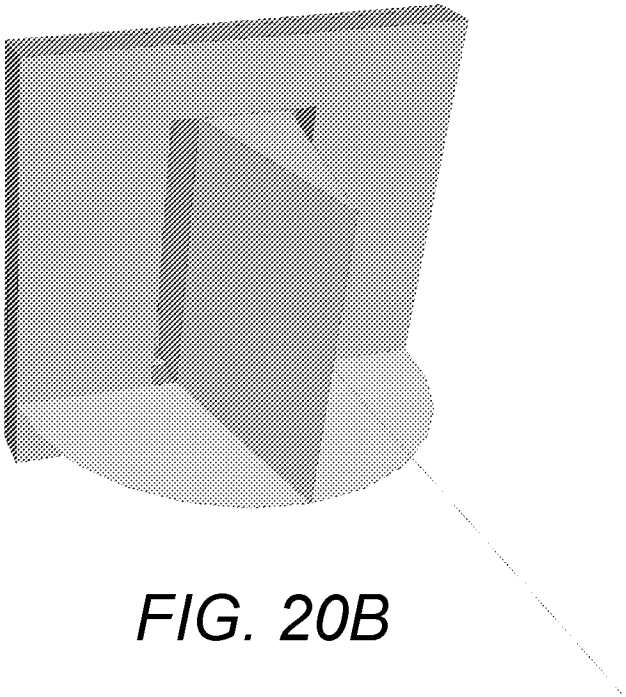
FIGS. 20A and 20B show variations in the construction of phase plugs for a low/mid frequency system. As can readily be appreciated, any of a variety of modifications in the number and dimensions of the channels of the phase plug can be utilized in accordance with embodiments of the invention as appropriate to the requirements of specific speaker assembly applications.
Figure 20A:
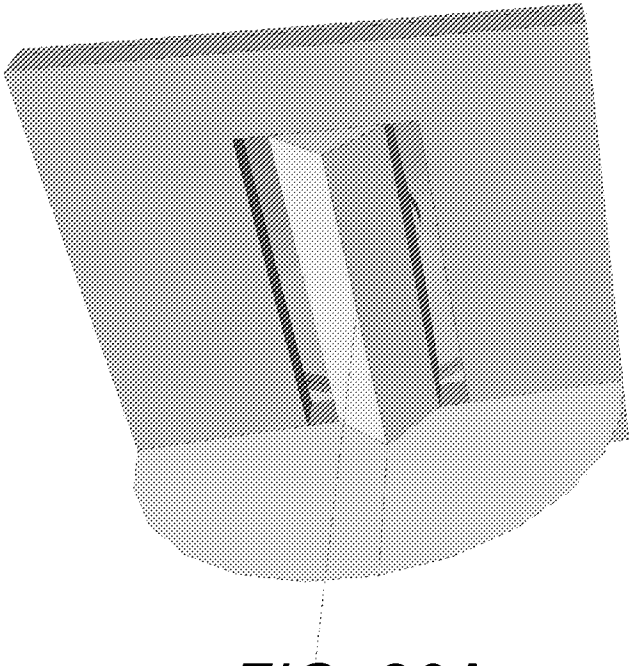
Figure 21:
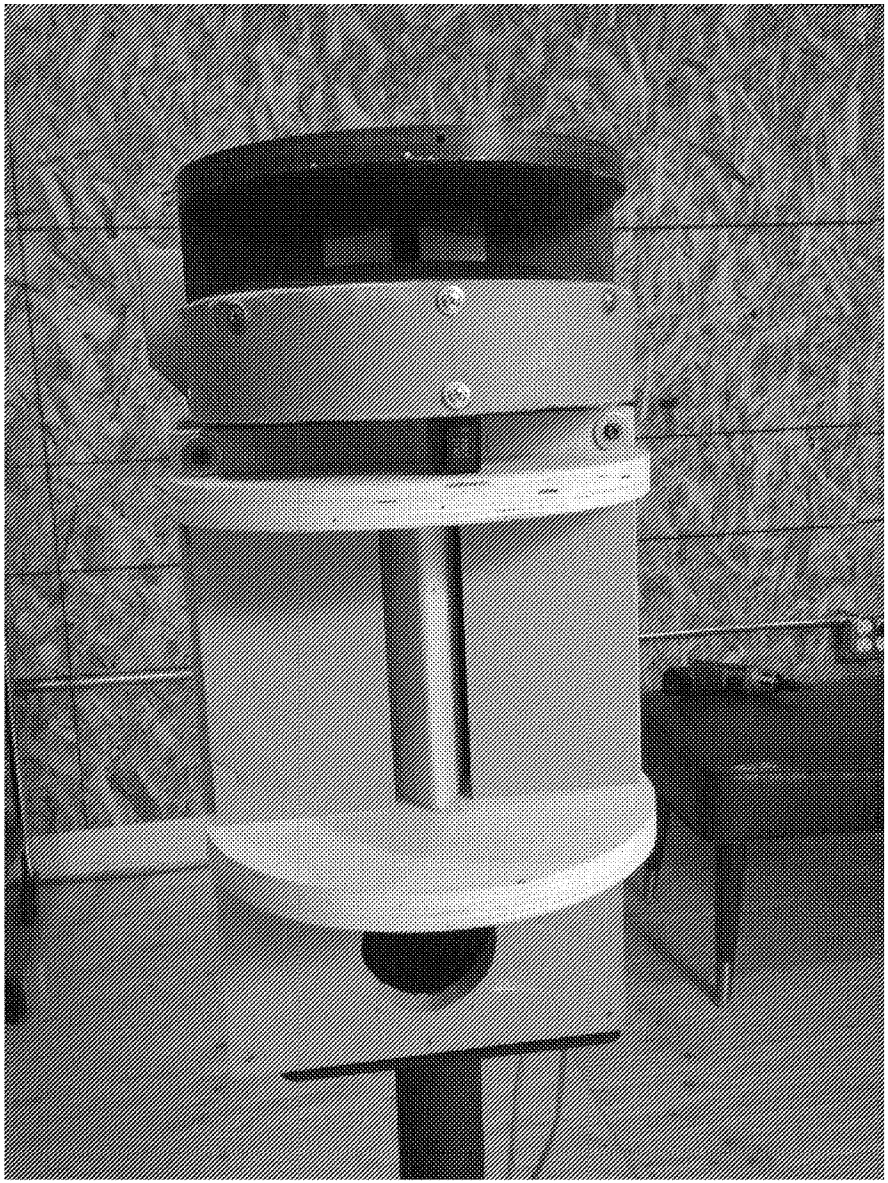
FIG. 21 is a photograph of a prototype of a two way system with 180 degree high frequency and 180 degree low/mid frequency diffraction baffles with horns. The low frequency system contains a phase plug and approximated "flatted" lips. The system is a bass reflex woofer cabinet with a compression tweeter mounted on top.
Figure 22C:
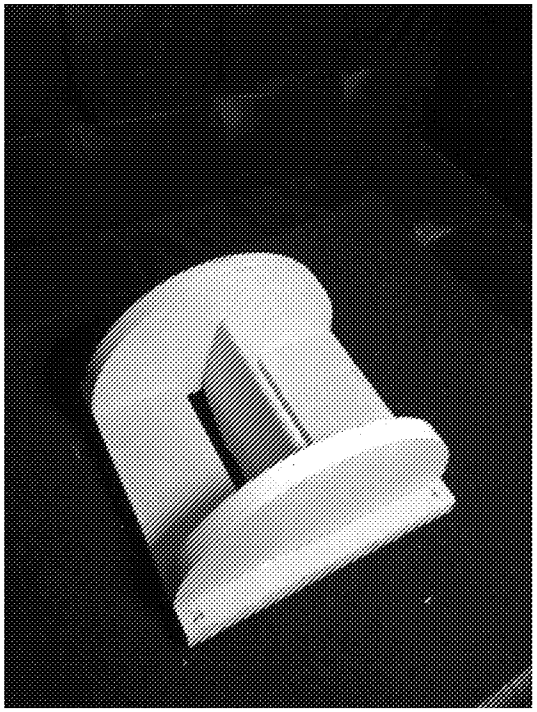
FIGS. 22A-22C is a photograph of a variation of a low/mid frequency diffraction baffle with phase plug and horn system.
Figure 22B:
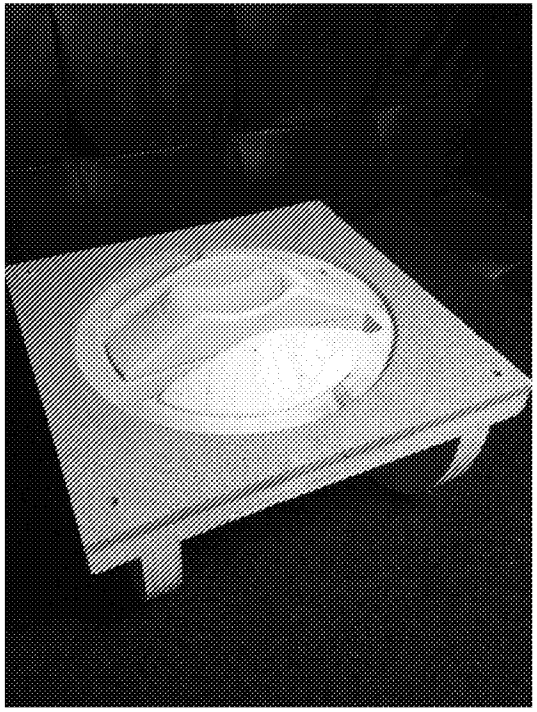
Figure 22A:
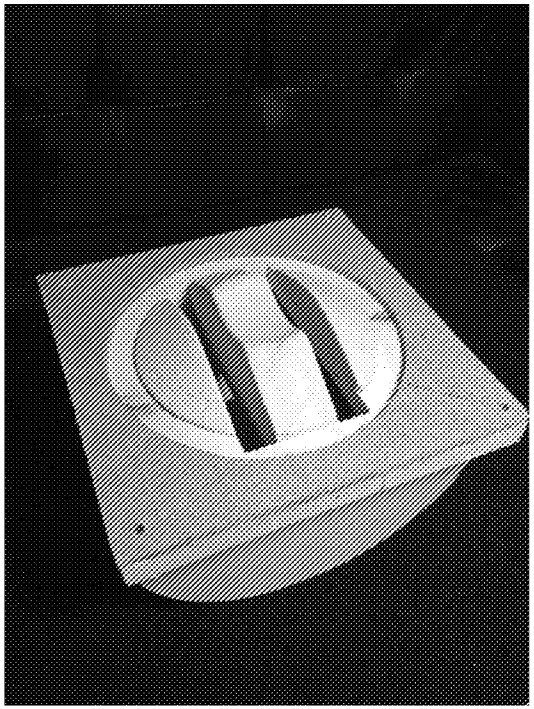

A front view of a throat region 612, baffle face 614, diffraction slot 616, and adapter portion 618 of a diffraction baffle in accordance with embodiments of the invention is illustrated in FIG. 6M. The vertical ridges protruding from the baffle face provide upper and lower throat surfaces 620 and 622 that bound the upper and lower sides of the exit of the diffraction slot 616. On the rear of the baffle face, an adapter portion 618 provides a circular entrance 624 that transitions to the rectangular diffraction slot 616.

Referring again to FIGS. 1-4, the result is that the shape of the throat 114 of the 180 degree high frequency diffraction baffle 106 creates a 180 degree horizontal dispersion pattern. The throat 114 of the 180 degree high frequency diffraction baffle 106 transitions to an exponential region 116 in which the horn portion is shaped to enable the area of the wavefront to expand at an exponential rate. The exponential region 116 transitions to a flared horn mouth 118 from which high frequency acoustic pressure waves can radiate. In the illustrated embodiment, the horn mouth 118 is designed for aesthetic effect. In other embodiments, a horn mouth that is part of the exponential flare of the horn can be utilized. In addition, similar horns can be utilized to create a wide horizontal dispersion pattern that is less than 180 degrees. In several embodiments, similar high frequency horns are used with speakers having horizontal dispersion patterns greater than 90 degrees. In many embodiments, similar high frequency horns are used with speakers having horizontal dispersion patterns in the range of 95 degrees to 180 degrees.

While specific high frequency drivers and horns are described above, any of a variety of high frequency drivers and diffraction baffles can be utilized as appropriate to the requirements of specific speaker assembly applications. Additional examples of high frequency diffraction baffles that can be utilized in speaker assemblies in accordance with various embodiments of the invention are illustrated in FIGS. 5, 6A, 6B, and 21. In other embodiments, any of a variety of high frequency diffraction baffles that result in a desired dispersion pattern can be utilized as appropriate to the requirements of a specific speaker assembly applications including (but not limited to) diffraction baffles that incorporate phase plugs to increase the width of the dispersion pattern of the diffraction baffle in a manner similar to that discussed below with respect to the phase plug incorporated within the 180 degree low/mid frequency diffraction baffle illustrated in the speaker assembly shown in FIGS. 1-4. Furthermore, horn portions of a diffraction baffle may be flat without any curvature such as in the embodiments illustrated in FIGS. 21 and 24.

Referring again to the cross-sections of the speaker assembly 100 shown in FIGS. 3 and 4, cross-sections of the low/mid frequency driver 120 and the 180 degree low/mid frequency diffraction baffle 108 are shown. In the illustrated embodiment, the low/mid frequency driver 120 is a compression driver and the 180 degree low/mid frequency diffraction baffle 108 incorporates a phase plug 122 that is spaced a small gap 123 away from the low/mid frequency driver 120. A phase plug acts as a mechanical interface between the low/mid frequency driver 120 and the 180 degree low/mid frequency diffraction baffle 108. Phase plugs are typically utilized to equalize sound wave path lengths from the driver to the listener, to reduce the effect of cancellations and frequency response problems that can result from interfering audio waves having different path lengths. In speaker assemblies in accordance with various embodiments of the invention, phase plugs are utilized that include channels from the low/mid frequency driver to the throat of the low/mid frequency diffraction baffle. In many embodiments, the phase plug is utilized as a mechanical interface to the low/mid frequency diffraction baffle and includes multiple channels that converge to a rectangular diffraction slot that is configured to drive acoustic pressure waves into the throat of the low/mid frequency diffraction baffle. The width of the diffraction slot to which the channels converge is typically determined based upon the high frequency cutoff of the frequency range of the woofer. In a number of embodiments, a diffraction slot that is as tall as the diaphragm of the low/mid frequency compression driver can be utilized with the width of the slot tuned based upon the operating range of the low/mid frequency compression driver and the area of the diaphragm of the compression driver. For example, a low/mid frequency driver with a 5 inch diameter can load a slot that is 2 inches wide and 6 inches high and achieve a 90 degree horizontal dispersion pattern around 6700 Hz and a significantly wider dispersion pattern at 3300 Hz, which is a good frequency for crossover between the woofer and the tweeter. As can readily be appreciated, the specific dimensions of the diffraction slot largely depend upon the requirements of particular applications. The dimensions of the phase plug typically depend upon the shape and excursion of the diaphragm of the compression driver. In the illustrated embodiment, a compression driver with an 8 inch diameter diaphragm is utilized. As can readily be appreciated the dimensions of the diaphragm are largely dependent upon the requirements of a specific speaker assembly application.

Figure 24:
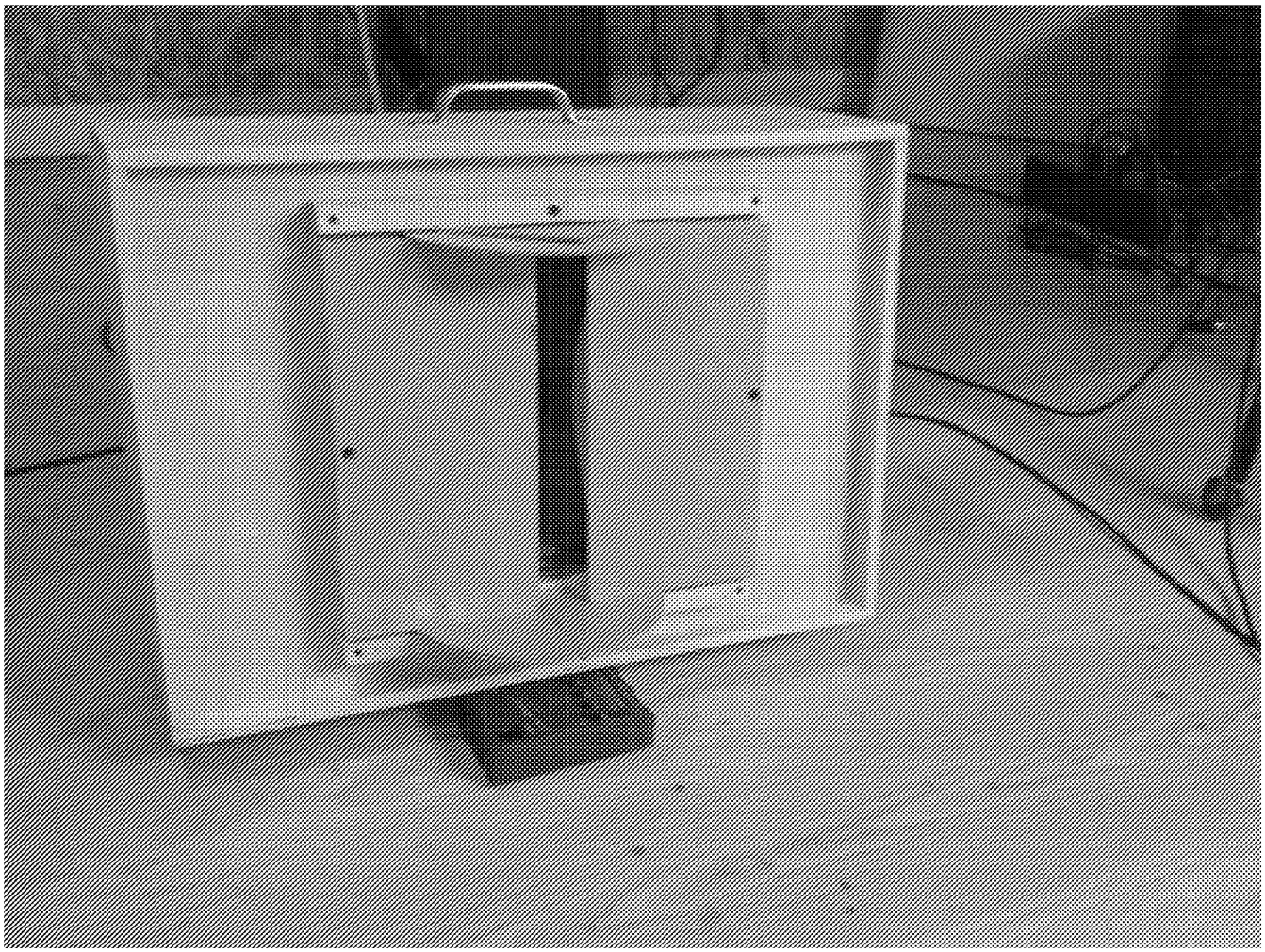
FIG. 24 is a photograph of a speaker assembly including a single driver that acts as a direct radiator below a cutoff frequency and drives a diffraction baffle with horn above the cutoff frequency in accordance with an embodiment of the invention.
Figure 25:
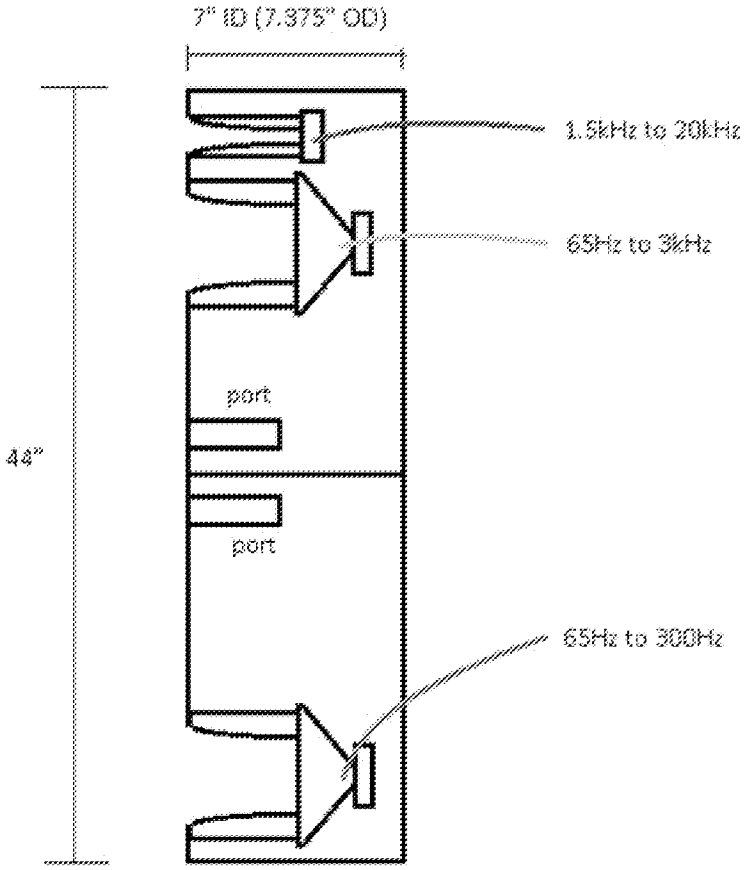
FIG. 25 conceptually illustrates a three way speaker assembly in accordance with an embodiment of the invention.
Figure 26B:
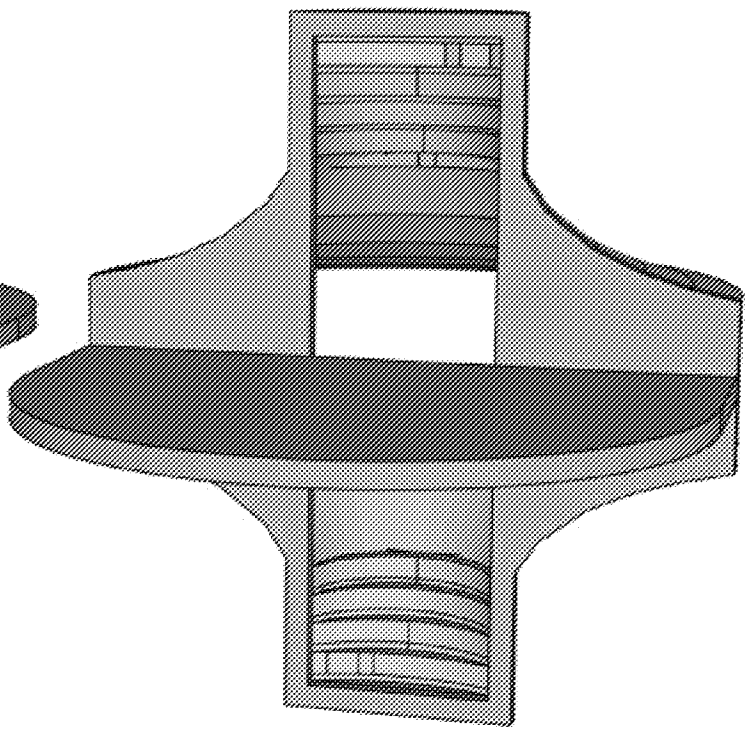
FIGS. 26A and 26B conceptually illustrate front and back views of a diffraction baffle with horn that can be utilized with a bass driver of a three way speaker assembly in accordance with an embodiment of the invention.
Figure 26A:
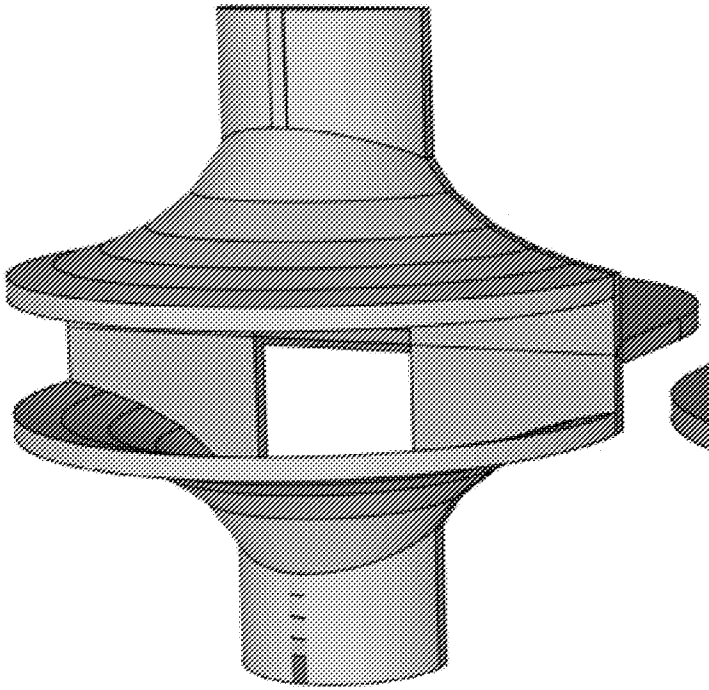
Figure 28:
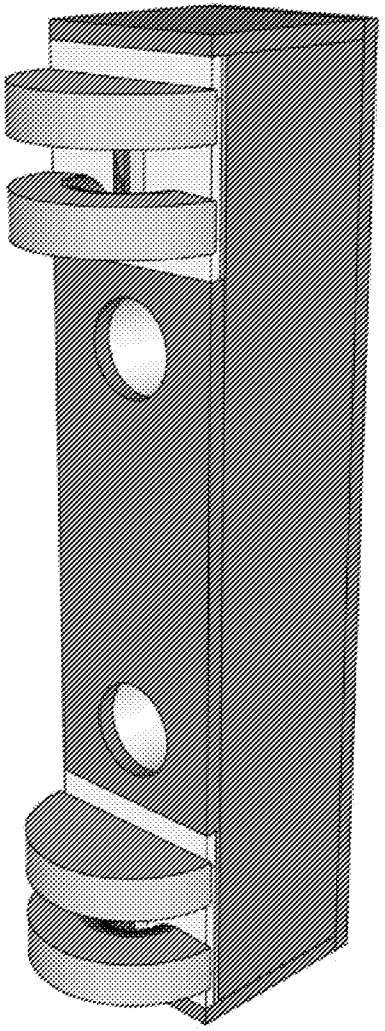
FIGS. 28 and 29 illustrate speaker assemblies including multiple drivers in accordance with various embodiments of the invention.
Figure 27:
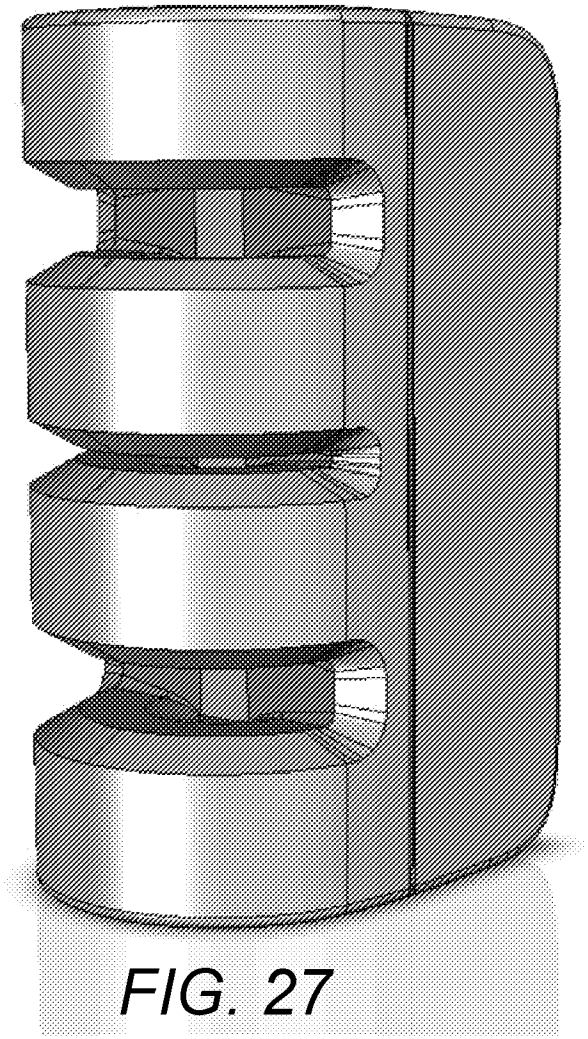
FIG. 27 conceptually illustrates a three way speaker assembly in accordance with another embodiment of the invention.
Figure 30:
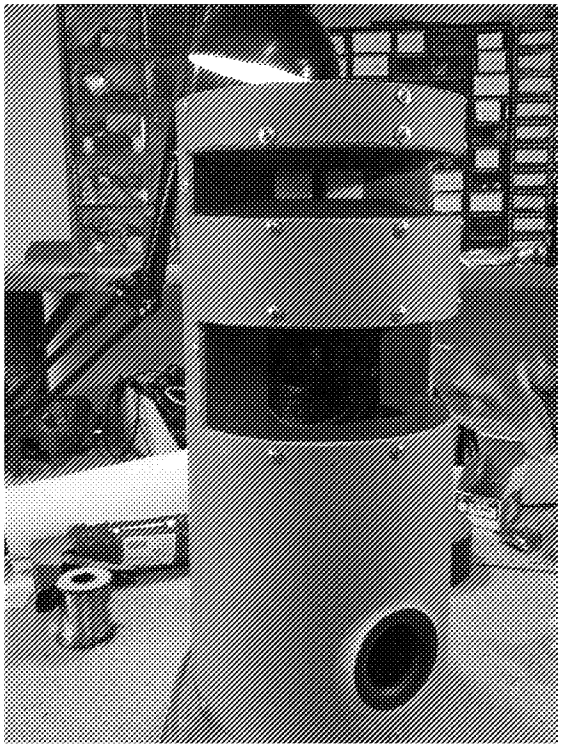
FIG. 30 is a photograph of a two way speaker assembly in accordance with an embodiment of the invention.
Figure 29:
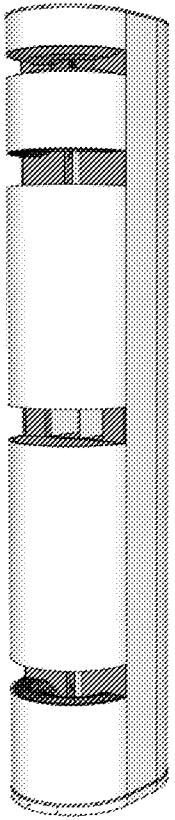

A diffraction slot can be utilized as the output for acoustic waves from the speaker driver without a phase plug such as in the embodiments illustrated in FIGS. 6A-B and 24. The diffraction slot can be dimensioned similarly as discussed above, where the width of the slot in the direction for wide dispersion is equal to the wavelength of the highest frequency (the target wavelength and target frequency) of the frequency band that it is designed for wide dispersion. Typically, this frequency band falls within the frequencies that the speaker driver produces. In several embodiments, the edges of the diffraction slot all fall within a single plane for the most ideal performance.

Furthermore, although specific phase plugs are described above with reference to FIGS. 1-4 any of a variety of phase plugs can be utilized in either the woofer or tweeter as appropriate to the specific requirements of a given speaker assembly application in accordance with embodiments of the invention. Various phase plugs that can be utilized as mechanical interfaces between low/mid frequency drivers and low/mid frequency diffraction baffles in accordance with embodiments of the invention are illustrated in FIGS. 16A, 16B, 17, 18A-18D, 19A-19J, 20A, 20B and 22A-22C. The specific phase plug design utilized is largely dependent upon the requirements of a given speaker assembly. In several embodiments, the phase plug does not protrude beyond the exit of the diffraction slot. In many embodiments, an acceptable audio quality can be obtained without the use of a phase plug and/or horn portion.

In many embodiments, the 180 degree low/mid frequency diffraction baffle 108 does not operate over the full operating frequency range of the low/mid frequency driver. Specifically, the 180 degree low/mid frequency diffraction baffle 108 behaves as a direct radiator below a cutoff frequency and operates as a horn above the cutoff frequency. In the illustrated embodiment, the cutoff frequency is above approximately 515 Hz. In many embodiments, diffraction baffles can be constructed with cutoff frequencies above approximately 350 Hz. By not utilizing the diffraction baffle to shape the wavefront of the acoustic pressure waves below the threshold frequency, the diffraction baffle can have a smaller form factor. The low/mid frequency diffraction baffle largely determines the overall size of the speaker assembly. Reducing the length of the diffraction baffle including a horn portion increases the cutoff frequency of the diffraction baffle. Therefore, the ability to drive the low/mid frequency driver below the cutoff frequency of the low/mid frequency diffraction baffle can be a key element of achieving a smaller form factor than typical speaker assemblies that utilize low/mid frequency diffraction baffles.

Referring again to FIGS. 3 and 4, the shape of the 180 degree low/mid frequency diffraction baffle 108 is illustrated. The shape of the 180 degree low/mid frequency diffraction baffle 108 is similar to that of the 180 degree high frequency diffraction baffle 106 of the speaker assembly 100 described above. In order to achieve a wide dispersion pattern, the throat of the 180 degree low/mid frequency diffraction baffle 108 compresses the wavefront of acoustic pressure waves driven into the throat of the diffraction baffle in a first direction (i.e. vertical) while allowing the wavefront to expand in a second direction (i.e. horizontal). In this way, the spherical wavefront is shaped by the throat of the diffraction baffle to achieve a 180 degree dispersion pattern in the second direction. The 180 degree low/mid frequency diffraction baffle includes an exponential 126 transition from the throat 124 of the diffraction baffle to the mouth of the horn portion. Although an exponential transition is shown, any of a variety of transitions can be utilized from the throat to the mouth of the horn including (but not limited to) a flat transition, a linear sloped transition, and/or any other transition appropriate to the requirements of a specific application. The specific flare utilized within the horn is typically influenced by a lower operational frequency cutoff of the horn and/or the desired audio quality of the speaker assembly.

Figure 4C:
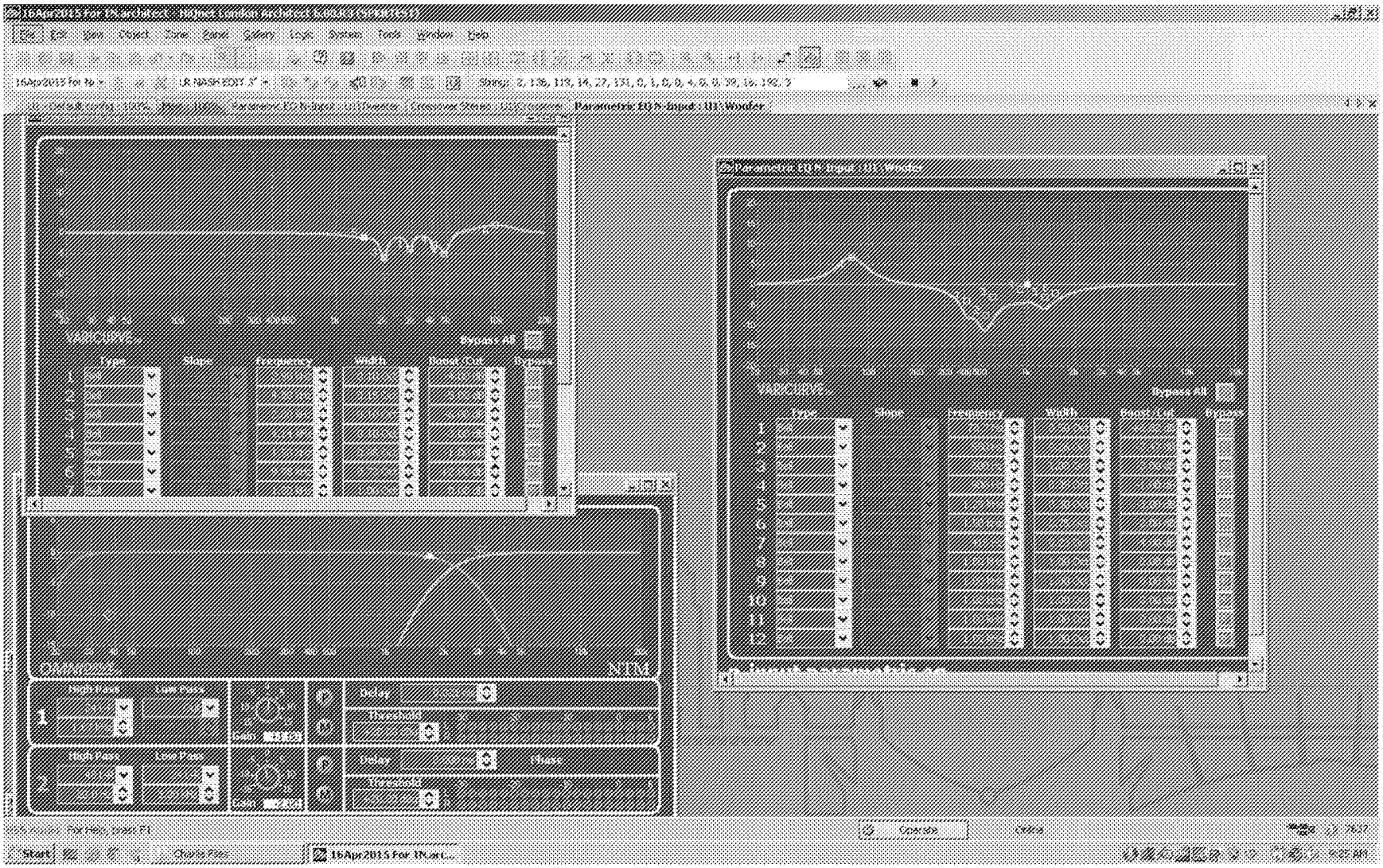
FIG. 4C illustrates a user interface of software showing an equalization profile for a speaker assembly including a woofer configured to act as a direct radiator below a cutoff frequency and to feed a horn above the cutoff frequency.
Figures 5A, 5B:
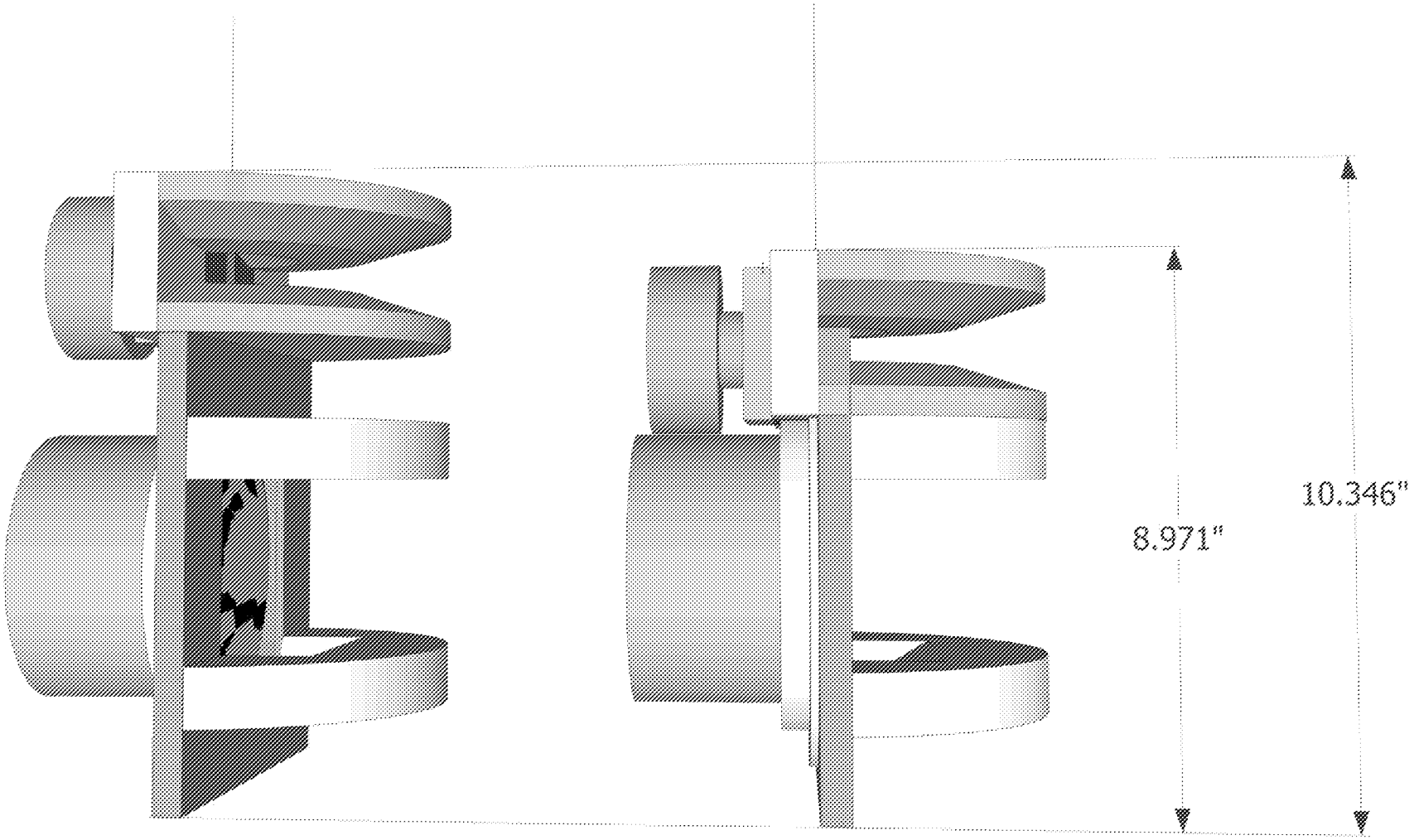
FIGS. 5A and 5B show the drivers and horns for a dual horn system showing joined horn flares and offset horn flares.

The use of a low/mid frequency diffraction baffle that is driven by a woofer above a cutoff frequency can result in the frequency response of the speaker assembly varying across the operational frequency band of the woofer. A diffraction baffle is typically more efficient than a direct radiator. Accordingly, equalization circuitry can be utilized to perform a combination of boosting of frequencies below a frequency cutoff and/or attenuating frequencies above the frequency cutoff. In many embodiments, the equalization applied to the signal used to drive the woofer can be described by an equalization curve that is the inverse of the efficiency gain for the diffraction baffle at frequencies above the cutoff frequency. An exemplary equalization curve is illustrated in FIG. 4C. As can readily be appreciated, the specific equalization curve applied by equalization circuitry (which can be implemented using analog and/or digital circuitry) typically depends upon the frequency response of a specific woofer and horn combination.

Although specific low/mid frequency diffraction baffle designs are described above with respect to FIGS. 1-4, any of a variety of horns that are configured to be driven by a low/mid frequency driver can be utilized in speaker assemblies in accordance with embodiments of the invention. Various low/mid frequency diffraction baffle designs in accordance with a number of embodiments of the invention are shown in FIGS. 5A, 5B, 7-15, and 21.

Figure 23:
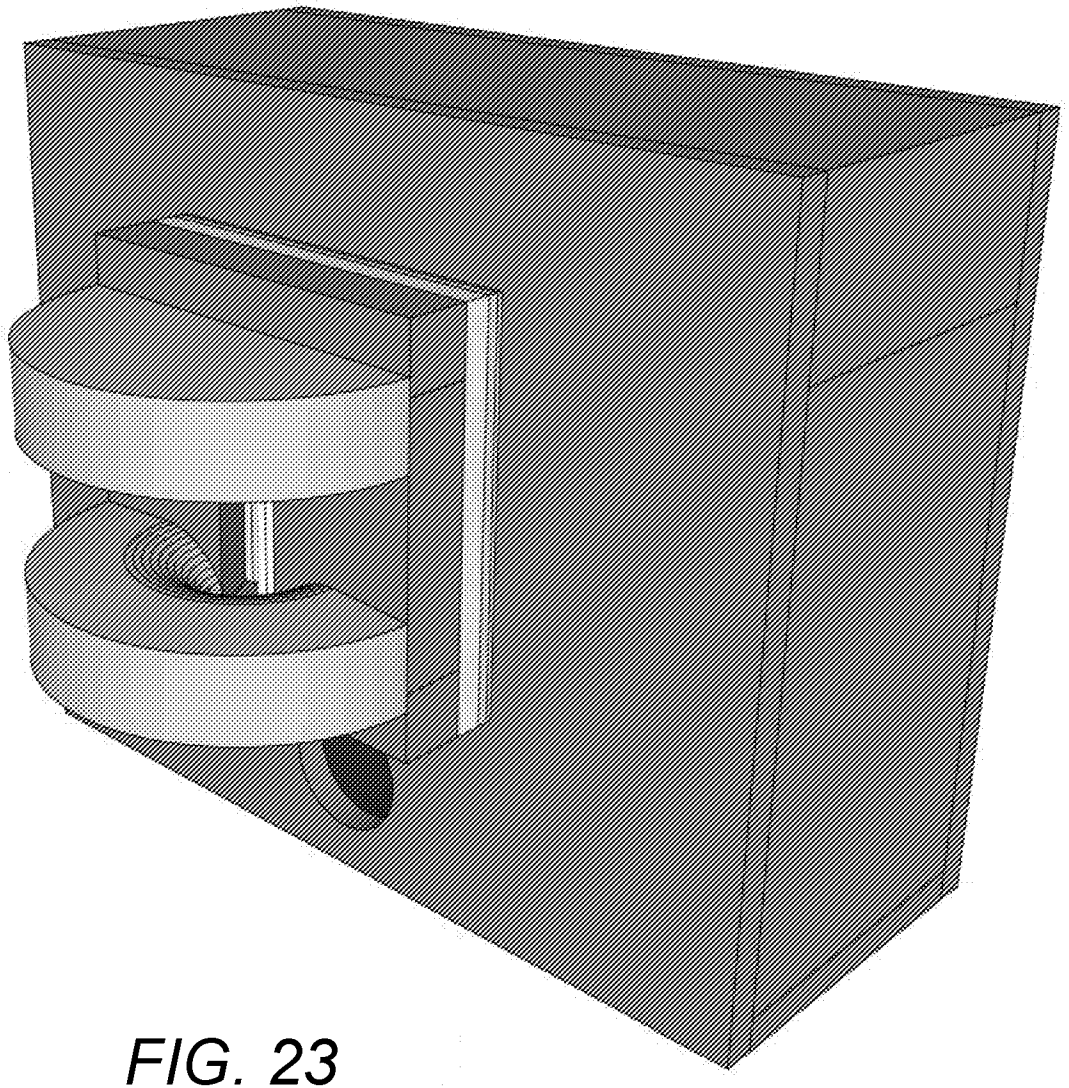
FIG. 23 illustrates a speaker assembly including a single driver that acts as a direct radiator below a cutoff frequency and drives a diffraction baffle with horn above the cutoff frequency in accordance with an embodiment of the invention.

While the above description contains many specific embodiments of the invention, these should not be construed as limitations on the scope of the invention, but rather as examples of embodiments thereof. Various other embodiments are possible within its scope. For example, FIGS. 23 and 24 illustrated speaker assemblies including a single driver and FIGS. 25-30 include speakers incorporating three or more drivers. Moreover, the orientation of elements can be changed, e.g., by rotation, translation, and/or direction, as appropriate to a particular application in accordance with embodiments of the invention. For example, while an upper throat surface and a lower throat surface are discussed above, a diffraction baffle may include any number of throat surfaces positioned in any of a variety of locations with respect to the diffraction slot in the diffraction baffle. Some embodiments include a left throat surface and a right throat surface instead of top and bottom throat surfaces. While the discussion above utilizes compression drivers, dome or cone or any of a variety of other types of drivers may be utilized to produce sound in various frequency ranges as appropriate to a particular application. Accordingly, the scope of the invention should be determined not by the embodiments illustrated, but by the claims made based upon the disclosure contained herein and their equivalents.

What is claimed is:

1. A speaker assembly for sound dispersion comprising:

at least two speaker drivers; and a diffraction baffle affixed to each of the speaker drivers, where each diffraction baffle includes a baffle face having a diffraction slot positioned over the corresponding speaker driver and each diffraction baffle is affixed to and sealed to the corresponding speaker driver such that substantially all acoustic pressure produced from the front of the driver passes through the diffraction slot;

wherein the area across each diffraction slot is less than the surface area of the corresponding speaker driver;

wherein each diffraction slot provides a path for substantially all of the acoustic pressure waves produced by the corresponding speaker driver to propagate away from the speaker driver and the acoustic pressure waves are within a frequency range determined by the characteristics of the speaker driver;

wherein the width of each diffraction slot in the horizontal direction is equal to the wavelength of a predetermined target frequency; and wherein each diffraction baffle includes a throat region comprising an upper throat surface protruding from the top of the exit of the diffraction slot and a lower throat surface protruding from the bottom of the exit of the diffraction slot, shaped to match its interface to the diffraction slot, wherein the slope of the upper throat surface and the slope of the lower throat surface are dimensioned to maintain the surface area of wavefronts of acoustic pressure waves at the predetermined target frequency to be constant at each distance the wavefronts progress through the throat region, and the throat region narrows in a vertical dimension towards its opposite end.

2. The speaker assembly of claim 1, wherein the at least two speaker drivers are oriented in vertical alignment with each other.

3. The speaker assembly of claim 1, wherein the at least two speaker drivers are oriented to face the same direction.

4. The speaker assembly of claim 1, further comprising:

an upper horn flare affixed to the upper throat surface of the throat region and oriented horizontally; and a lower horn flare affixed to the lower throat surface of the throat region and oriented horizontally.

5. The speaker assembly of claim 4, wherein the upper horn flare and the lower horn flare are curved with an exponential transition.

6. The speaker assembly of claim 1, wherein one of the speaker drivers is a tweeter and the width of the diffraction slot over the tweeter is 0.5 inch.

7. The speaker assembly of claim 1, wherein one of the speaker drivers is a woofer and the width of the diffraction slot over the woofer is 1.625 inches.

8. The speaker assembly of claim 1, wherein at least one diffraction baffle further comprises a phase plug positioned over the corresponding speaker driver and forming an inner path toward the corresponding diffraction slot.

9. The speaker assembly of claim 1, wherein the edges of the exit of each diffraction slot all fall within one plane.

10. The speaker assembly of claim 9, wherein the edges of the exit of each diffraction slot fall within one plane in an orientation parallel to the orientation of the corresponding speaker driver.

11. The speaker assembly of claim 1, wherein the predetermined target frequency associated with each diffraction slot is at the upper bound of the frequency range produced by the corresponding speaker driver.

12. The speaker assembly of claim 1, wherein the baffle face is sealed to the speaker driver such that the diffraction slot forms a path for substantially all acoustic pressure of the audio pressure waves to emanate from the speaker driver.

13. The speaker assembly of claim 1, wherein the throat region is shaped to compress an acoustic pressure wave from the speaker driver in the vertical direction and expand the acoustic pressure wave in the horizontal direction.

14. The speaker assembly of claim 1, further comprising a phase plug positioned in the diffraction slot, where the phase plug provides multiple channels from its rear surface facing the speaker driver that converge at the exit of the diffraction slot on the front surface.

15. The speaker assembly of claim 14, wherein the phase plug provides two rectangular channels that converge to a rectangular diffraction slot.

16. The speaker assembly of claim 14, wherein the rear surface of the phase plug is shaped to conform to the center cone portion of the speaker driver.

17. The speaker assembly of claim 1, wherein the diffraction slot and the curvature of the throat region thereby shape acoustic pressure waves at and lower than the predetermined target frequency generated by the speaker driver and passing through the diffraction slot to radiate in a pattern wider than they were before passing through the diffraction slot and to radiate in a pattern greater than 120 degrees.

18. The speaker assembly of claim 1, wherein the diffraction slot is rectangular.

19. The speaker assembly of claim 1, wherein the diffraction slot is round.

20. The speaker assembly of claim 1, wherein the upper throat surface and the lower throat surface extend a distance equal to half the width of the diffraction slot.

21. A speaker assembly for sound dispersion comprising:

at least two speaker drivers;

a diffraction baffle affixed to each of the speaker drivers, where each diffraction baffle includes a baffle face having a diffraction slot positioned over the corresponding speaker driver and each diffraction baffle is affixed to and sealed to the corresponding speaker driver such that substantially all acoustic pressure produced from the front of the driver passes through the diffraction slot; and an adaptor portion positioned between one of the speaker drivers and the corresponding diffraction slot, where the adaptor portion comprises a constant transition surface shaped at the interface to the diffraction slot to match the shape of the entrance to the diffraction slot and shaped circular at its opposite end facing the speaker driver, and shaped to maintain a constant cross-sectional area in planes parallel to the orientation of the speaker driver;

wherein the area across each diffraction slot is less than the surface area of the corresponding speaker driver;

wherein each diffraction slot provides a path for substantially all of the acoustic pressure waves produced by the corresponding speaker driver to propagate away from the speaker driver and the acoustic pressure waves are within a frequency range determined by the characteristics of the speaker driver; and wherein the width of each diffraction slot in the horizontal direction is equal to the wavelength of a predetermined target frequency.

22. The speaker assembly of claim 21, wherein the at least two speaker drivers are oriented in vertical alignment with each other.

23. The speaker assembly of claim 21, wherein the at least two speaker drivers are oriented to face the same direction.

24. The speaker assembly of claim 23, wherein the upper horn flare and the lower horn flare are curved with an exponential transition.

25. The speaker assembly of claim 21, wherein one of the speaker drivers is a tweeter and the width of the diffraction slot over the tweeter is 0.5 inch.

26. The speaker assembly of claim 21, wherein one of the speaker drivers is a woofer and the width of the diffraction slot over the woofer is 1.625 inches.

27. The speaker assembly of claim 21, wherein at least one diffraction baffle further comprises a phase plug positioned over the corresponding speaker driver and forming an inner path toward the corresponding diffraction slot.

28. The speaker assembly of claim 21, wherein the edges of the exit of each diffraction slot all fall within one plane.

29. The speaker assembly of claim 28, wherein the edges of the exit of each diffraction slot fall within one plane in an orientation parallel to the orientation of the corresponding speaker driver.

30. The speaker assembly of claim 21, wherein the predetermined target frequency associated with each diffraction slot is at the upper bound of the frequency range produced by the corresponding speaker driver.

31. The speaker assembly of claim 21, wherein the baffle face is sealed to the speaker driver such that the diffraction slot forms a path for substantially all acoustic pressure of the audio pressure waves to emanate from the speaker driver.

32. The speaker assembly of claim 21, further comprising a phase plug positioned in the diffraction slot, where the phase plug provides multiple channels from its rear surface facing the speaker driver that converge at the exit of the diffraction slot on the front surface.

33. The speaker assembly of claim 32, wherein the phase plug provides two rectangular channels that converge to a rectangular diffraction slot.

34. The speaker assembly of claim 32, wherein the rear surface of the phase plug is shaped to conform to the center cone portion of the speaker driver.

35. The speaker assembly of claim 21, wherein the diffraction slot is rectangular.

36. The speaker assembly of claim 21, wherein the diffraction slot is round.

* * * * *